US007108024B2

(12) United States Patent
Navarro

(10) Patent No.: US 7,108,024 B2
(45) Date of Patent: Sep. 19, 2006

(54) APPARATUS FOR THE SIMULTANEOUS FILLING OF PRECISE AMOUNTS OF VISCOUS LIQUID MATERIAL IN A SANITARY ENVIRONMENT

(75) Inventor: Ramon M. Navarro, Orange, CA (US)

(73) Assignee: Cott Technologies, Inc., La Puente, CA (US)

( * ) Notice: Subject to any disclaimer, the term of this patent is extended or adjusted under 35 U.S.C. 154(b) by 186 days.

(21) Appl. No.: 10/775,217

(22) Filed: Feb. 11, 2004

(65) Prior Publication Data

US 2005/0173019 A1 Aug. 11, 2005

(51) Int. Cl.
*B65B 1/04* (2006.01)

(52) U.S. Cl. ..... 141/127; 141/90; 141/91; 141/237; 141/238; 134/169 C

(58) Field of Classification Search ..... 141/85, 141/89–92, 234, 237, 238, 242, 245, 258, 141/18, 127; 134/166 R, 169 R, 166 C, 134/170; 222/129, 148, 71
See application file for complete search history.

(56) References Cited

U.S. PATENT DOCUMENTS

| | | | | |
|---|---|---|---|---|
| 1,977,138 | A * | 10/1934 | Newey | 141/92 |
| 3,834,428 | A * | 9/1974 | Rademacher | 141/39 |
| 6,105,634 | A * | 8/2000 | Liebram et al. | 141/91 |
| 6,401,771 | B1 * | 6/2002 | Kondo et al. | 141/90 |

* cited by examiner

*Primary Examiner*—Timothy L. Maust
(74) *Attorney, Agent, or Firm*—Breneman & Georges; Todd A. Vaughn

(57) ABSTRACT

An automated apparatus for the simultaneous filling of precise quantities of viscous liquid material to a plurality of containers in a sanitary environment, including a sanitary pump for delivering under pressure the viscous liquid material to a viscous liquid material manifold, a pump pulsation dampening assembly for dampening any pulsating output produced by the sanitary pump, and a plurality of fill valves for simultaneously dispensing a precise amount of viscous liquid material to the containers during a filling operation.

51 Claims, 22 Drawing Sheets

APPARATUS FOR THE SIMULTANEOUS FILLING OF PRECISE AMOUNTS OF VISCOUS LIQUID MATERIAL IN A SANITARY ENVIRONMENT

BACKGROUND OF THE INVENTION

1. Field of the Invention

This invention relates generally to an automated apparatus for the high-speed delivery of precisely measurable quantities of a variety of viscous liquid materials having varying characteristics to a plurality of containers in a sanitary environment.

2. Description of the Related Art

A wide variety of sanitary filling operations, especially in the pharmaceutical and food processing industries require high-speed fluid metering systems capable of delivering precisely measured quantities of viscous liquid materials at accurate flow rates to various locations and in a sanitary manner. Typical filling operations involve a delivery apparatus for delivering viscous liquid material to a viscous liquid material manifold, and a plurality of fill heads adapted to simultaneously dispense the viscous liquid material into a batch or plurality of empty vessels (i.e., bottles, containers or the like) to a plurality of fill heads.

Modern sanitary filling operations require high speed operations involving pressure having ranges of 400 pounds per square inch (psi) or greater and pumping cycles in the range of about 20–200 cycles per minute and preferably 60–160 cycles per minute to provide constant flow. Accordingly, in such operations, precise and accurate delivery of the viscous liquid material is critical.

Moreover, such sanitary filling operations must meet the performance requirements established by the U.S. Food and Drug Administration (FDA), which require that machines used to fill containers with liquid food or drug materials must be sterilizable, and readily cleaned of liquid materials which might be trapped in cavities within machine parts, and thereby providing a growth media for microbes. Accordingly, a goal in the design and construction of in-line filling machines for liquid food materials is that to provide an attachment as well as components suitable for cleaning-in-place (CIP) operations.

Heretofore, pump delivery systems that pump viscous liquid materials to various sources in precise and accurate flow rates are difficult to achieve due to the pulsing, surging, or hydraulic shock generated by the output of the pump mechanism. Such pulsing, surging or otherwise hydraulic shock is undesirable since it typically results in hydraulic hammer in process lines, large pressure fluctuations, excessive wear and increased cost of maintenance of pumps and instruments, inaccurate flow rates during delivery operations, which results in increased material costs and time. Moreover, conventional fill heads do not permit adjustable regulation of the flow rate of the viscous liquid material during filling operations at a point between the inlet to the fill head and the fill head chamber. Such fill heads also lack adjustable regulation of the flow rate in accordance with physical characteristics such as density, viscosity, compressibility and pump pressure of the viscous liquid material being dispensed. Such fill heads also permit turbulent flow during filing operations that thereby result in the dispensing of imprecise amounts of viscous liquid material.

What is presently needed is an apparatus that is equipped for high pressure and high-speed fluid metering and pumping (i.e., pressure ranges of 400 pounds psi or greater and pumping cycles in the range of about 20–200 cycles per minute and preferably 60–160 cycles per minute) in delivering precise measured quantities of viscous liquid materials at accurate flow rates. Such an apparatus should also be adaptable for use in sanitary filling operations and also include a pump pulsation dampening assembly that also meets the cleaning-in-place standards required by the FDA. Such an apparatus should also be adaptable to automatically monitor and adjust the air-to-liquid ratio inside a pump pulsation dampening assembly in response to the duration and intensity of the pulsating fluid flow from the pump mechanism. Such an apparatus should also accommodate varying viscosities of the metered viscous liquid material in addition to variations in compressibility due to the location of each fill valve relative to the fill station which receives the viscous liquid material from the fluid manifold as well as various parameters involved during a filling operation.

SUMMARY OF THE INVENTION

Accordingly, it is an object of the invention to provide an automated apparatus capable of delivering in a high-speed fashion precisely measurable quantities of viscous liquid materials in a sanitary environment.

It is another object of the invention to provide such an apparatus that is capable of sanitarily delivering in a high-speed operation a variety of viscous liquid materials having varying characteristics.

It is an additional object of the invention to provide such an apparatus that utilizes a pump delivery assembly including a pump and a pump pulsation dampener that combines to facilitate the efficient delivery of the viscous liquid material to a plurality of fill valves by dampening the pulsating flow output generated by the pump.

It is a further object of the invention to provide such an apparatus with a sanitary fill valve that fill heads substantially reduces turbulent flow during filling operations.

It is yet another object of the invention to provide such an apparatus having a plurality of sanitary fill valves adaptable to adjustably regulate the flow rate of viscous liquid material during a filling operation to thereby permit simultaneous filling of precise amounts of the viscous liquid material to the containers.

It is still another object the invention to provide such an apparatus with working components that are cleanable-in-place (CIP).

In accordance with these objects and the principles of the invention, provided herein is an apparatus for the precise metering of a various viscous liquid materials to a plurality of containers in a sanitary environment, including a sanitary pump mechanism for delivering the viscous liquid material under pressure to a viscous liquid material manifold, a pump pulsation dampening assembly provided in series between the sanitary pump mechanism and the viscous liquid material manifold for substantially dampening any pulsating fluid flow of the viscous liquid material from the sanitary pump, the pump pulsation dampening assembly having a sanitary cleaning mechanism that permits a cleaning-in-place operation of the pump pulsation dampening assembly; and a plurality of sanitary fill valves for drawing the viscous liquid material from the viscous liquid material manifold and simultaneously dispensing a precise metered amount of the viscous liquid material into the containers.

In accordance with another aspect of the invention, the apparatus includes a sanitary pump delivery system for delivering a liquid under pressure to a viscous liquid material manifold, the sanitary pump delivery system being adaptable to also dampen a pulsating output of the viscous liquid material during a filling operation; and a plurality of fill valves each adaptable to draw the viscous liquid material from the viscous liquid material manifold and dispense precise metered amounts of the viscous liquid material into the containers, each one of the fill valves being in communication with the viscous liquid material manifold via a fill valve station and also having a flow regulator for automatically regulating the rate of flow of the viscous liquid material from the fill valves based upon the location of a respective one of the fill valve stations relative to the manifold to thereby permit the simultaneous dispensing of precise amounts of viscous liquid material to the containers.

In accordance with yet another aspect of the invention, the apparatus includes a sanitary pump mechanism for delivering the viscous liquid material to a viscous liquid material manifold, the sanitary pump mechanism including a housing sized to receive a piston cylinder having a piston head for reciprocating movement therein, a drive mechanism for driving the piston cylinder, and removeably sealable endplates for closing the ends of the housing, the housing having a first inlet port and a first outlet port disposed on one side of the housing, and a second inlet port and a second outlet port disposed on the other side of the housing, each one of the first inlet port, the first outlet port, the second inlet port and the second outlet port having a check valve disposed therein; a pump pulsation dampening mechanism for dampening a pulsating fluid flow from the sanitary pump mechanism; and a plurality of fill valves for drawing the viscous liquid material from the viscous liquid material manifold and dispensing a precise metered amount of the viscous liquid material into a respective container.

Accordingly, the sanitary filling apparatus in accordance with the invention is advantageous in being adaptable to quickly and efficiently deliver a variety of viscous liquid materials in a sanitary fashion. For instance, the combination of the sanitary pump, pulsation dampener and fill valve permits simultaneous filling operations of a plurality of containers with precise amounts of viscous liquid material regardless of whether the container is upstream or downstream of the manifold, and regardless of temperature or humidity of the outside environment in which the sanitary filling apparatus is located.

The sanitary pump is simplistic in design, utilizes interchangeable parts, and has rapid disassembly of the components to provide for clean-in-place (CIP) advantages required for dispensing viscous liquid material in the food processing and pharmaceutical industry. These same CIP and disassembly advantages permit the sanitary pump to be disassembled and transported easily to remote locations to establish pumping operations in either sanitary or non-sanitary environments or applications where reliability, high pressure, high flow and particularly a constant pressure pump is desired. Moreover, the sanitary pump of the invention utilizes high-speed, sanitary and interchangeable check valves which permit the pump to operate at speeds up to and exceeding 200 cycles per minute utilizing a positively controlled drive shaft.

The pulsation dampener provides additional advantages to the sanitary filling apparatus in being adaptable to automatically reduce undesirable pulsating outputs from the sanitary pump, thereby resulting in consistent flow rates during filling operations, which has the added benefit of reducing production costs and increasing manufacturing output. The pulsation dampener also meets CIP requirements in providing a sanitary cleaning mechanism for cleaning-in-place (CIP) the interior surface of the pressurized vessel used to dampen the pump pulsations.

The fill valves in accordance with the invention are advantageous in being adaptable to rapidly and efficiently meter simultaneously precise quantities of viscous liquid material into a plurality of containers, even under varying physical conditions of the dispensed viscous liquid material and the outside environment. Each fill valve of the invention also reduces turbulent flow during a filling operation to thereby permit dispensing of the viscous liquid material without unwanted splashing or gaseous bubble formation. Moreover, each fill valve also provides for efficient and quick filling operations in automatically regulating the rate of flow of the viscous liquid material to take into account various operating conditions (i.e., temperature, pressure, humidity, etc.). Each fill valve also provides for an independent cleaning-in-place operation to occur at the outlet passage of each fill valve to thereby reduce undesirable dripping of the dispensed viscous liquid material.

The aforementioned advantages of the apparatus are further augmented by the utilization of stainless steel, glass, high density plastic or other material in the fabrication of the pump and components that are compatible with high purity material handling requirements in components substantially free from cracks, seams, threads and other components that would capture and provide breeding surfaces for bacteria or other deleterious substances.

These and other objects, features and advantages of the invention will become more apparent from the following description when taken in conjunction with the detailed drawings that show, for purposes of illustration only, the preferred embodiments of the invention.

BRIEF DESCRIPTION OF THE DRAWINGS

The advantages of the invention will become more apparent to those skilled in the art in conjunction with the detailed description of the preferred embodiments of the invention, in which.

DETAILED DESCRIPTION OF THE INVENTION

Figure 1:
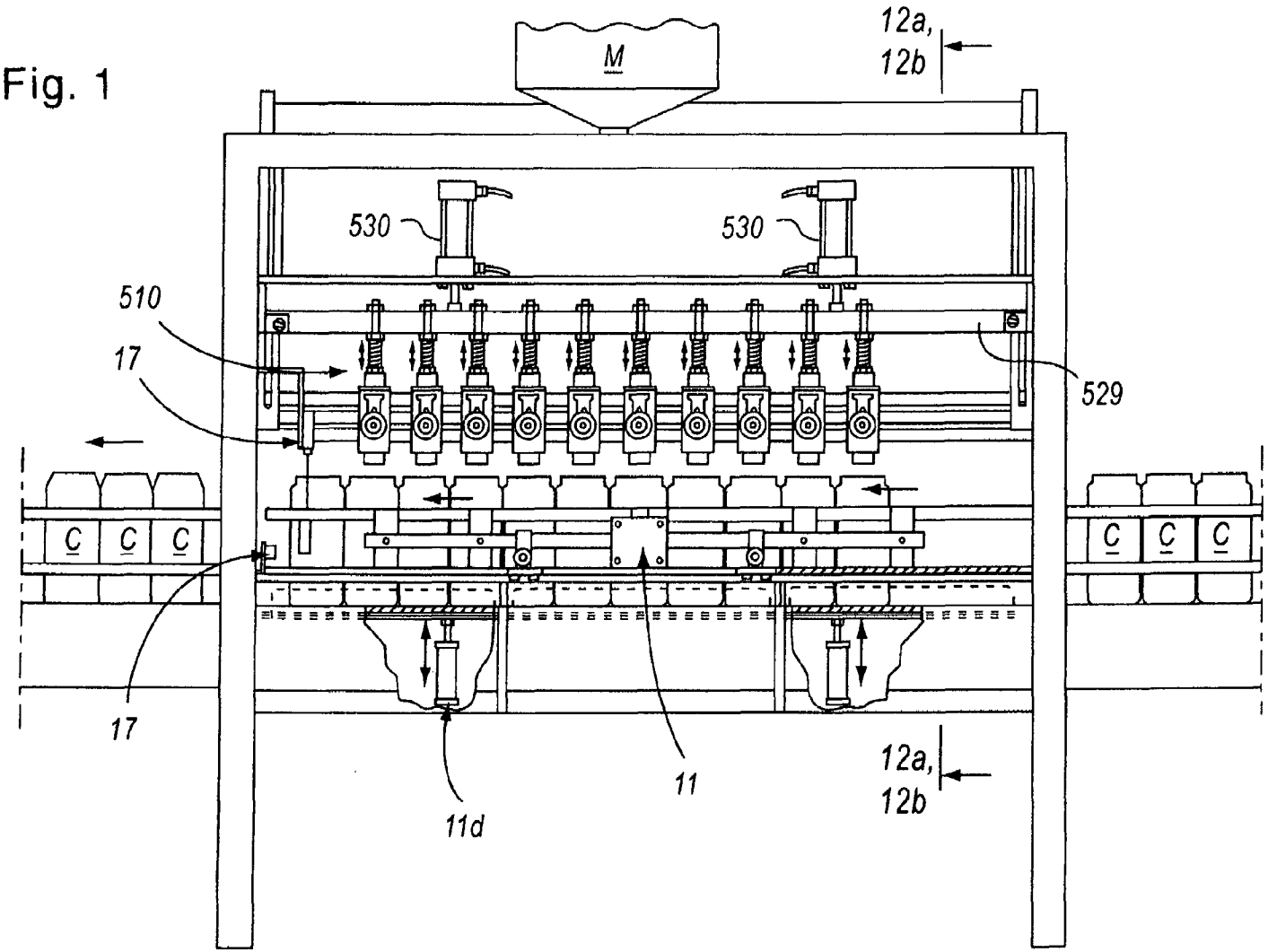
FIG. 1 is a front perspective view of an apparatus for the sanitary filling of containers with viscous liquid material in accordance with the invention.

As shown in FIGS. 1–29, the sanitary filling apparatus includes the combination of a sanitary pump mechanism 10 for delivering viscous liquid material L nder pressure in precise amounts to a viscous liquid material manifold M, a pump pulsation dampening assembly 350 provided in series between the sanitary pump mechanism 10 and the viscous liquid material manifold M for substantially reducing the pulsating fluid flow of the viscous liquid material, and a plurality of sanitary fill valves 510 arranged sequentially and coaxially above a plurality of containers C for drawing the viscous liquid material L from the viscous liquid material manifold M and simultaneously filling or otherwise dispensing a precise metered amount of the viscous liquid material L into the containers C. The fill valves 510 are removably attached to a horizontally disposed press bar 529, the fill valve 510 having at least one pair of pneumatic valve actuator cylinders 530 for displacing a respective valve piston body 521 from a first retracting/upward position which draws a predetermined volume of the viscous liquid material L into the fill valve chamber 512 via negative pressure created therein and a second extending/downward position which simultaneously meters an exact amount of viscous liquid material L into each container C.

Figure 2:
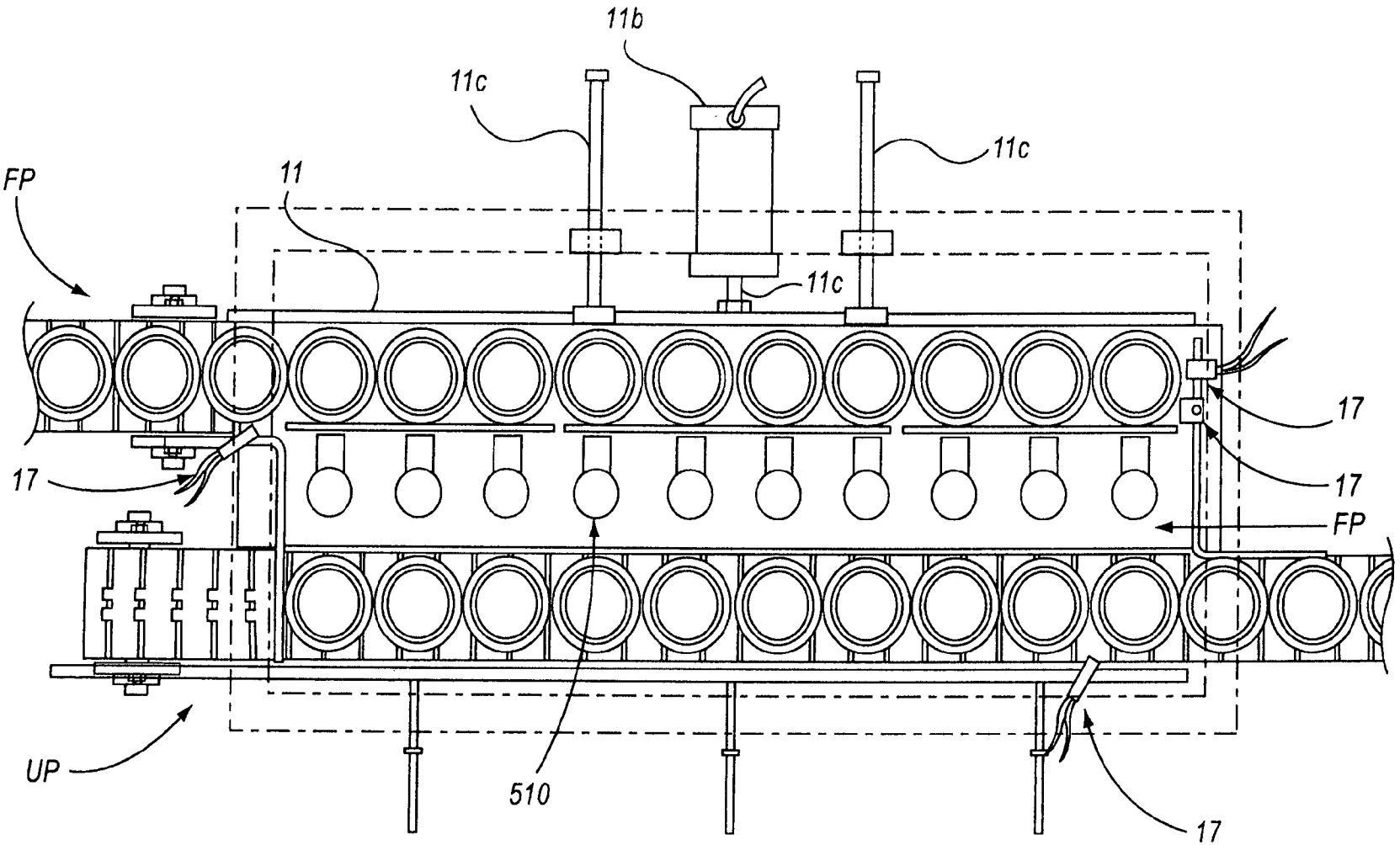
FIG. 2 is a top perspective view of the apparatus shown in FIG. 1 with the indexer in is third indexing position.
Figure 3:
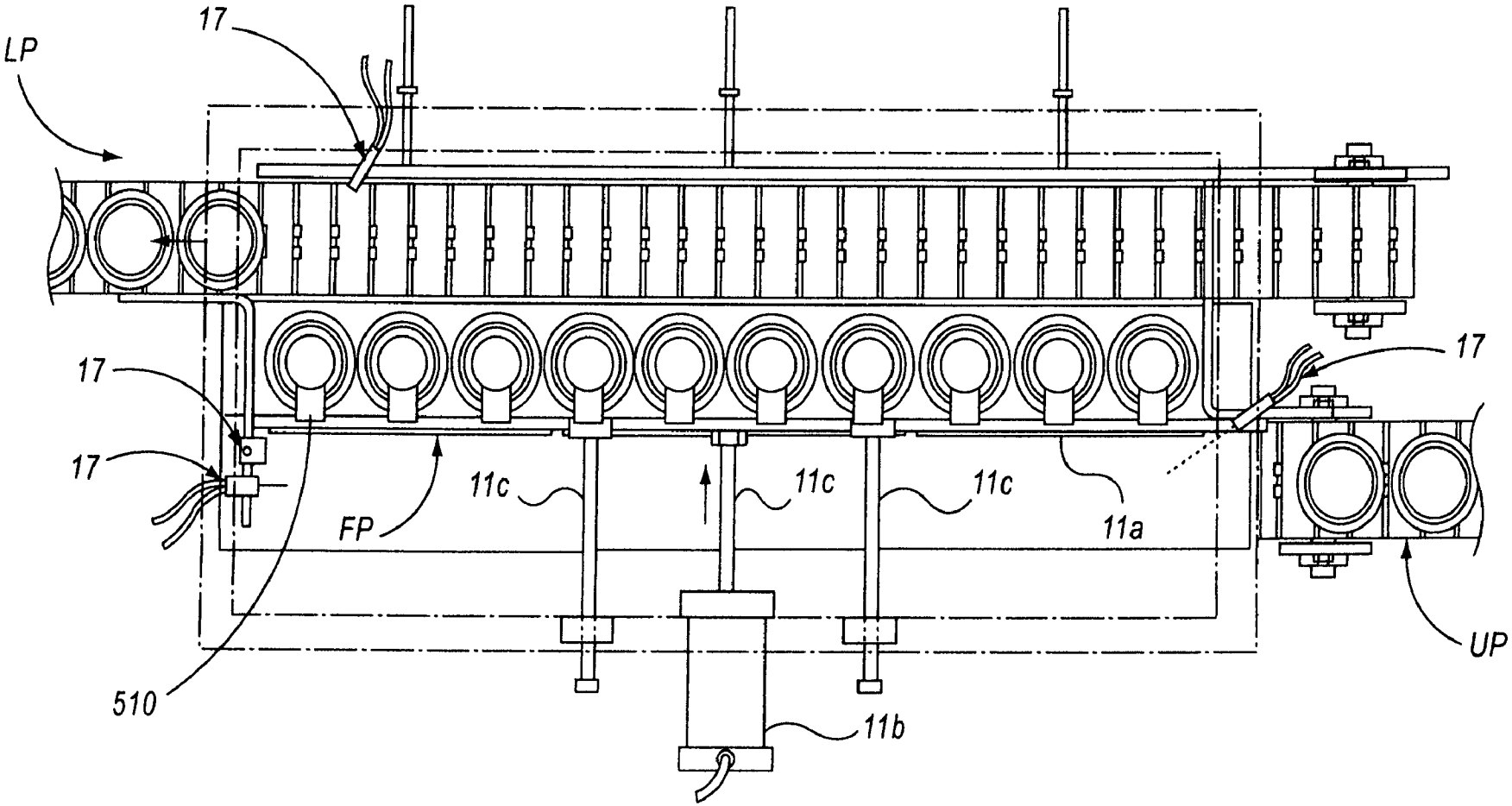
FIG. 3 is a top perspective view of the apparatus shown in FIG. 1 with the indexer in its second indexing position.

As illustrated in FIGS. 1–3, a first plurality or batch of empty containers C arranged in a row is transported by an inlet conveyor into a position adjacent to a second stationary filling platform FP, the inlet conveyor serving as a loading platform LP for the empty containers C. Positioned adjacent the inlet conveyor is an indexer 11 which laterally manipulates the empty containers C toward and onto the filling platform FP in a coaxial position beneath the fill valves 510. The indexer 11 includes a horizontally disposed arm 11*a*, bumpers (not shown) protruding from an outer surface of the arm 11*a* and a pneumatic actuator cylinder 1*b* and cylinder rods 1*c* for reciprocating the arm 11*a* between a first position which positions the containers C on the filling platform FP, a second position in which in filled containers C are manipulated to third platform conveyor which serves as an unloading platform UP, and a third position in the arm is at rest in preparation for a second batch of containers C. Each platform may be provided with a plurality of sensors 17 for sensing various operating conditions such as the initiation and/or completion of a filling cycle, and/or the presence of containers C on each platform. As is readily understood by those of ordinary skill in the art, each conveyor is driven by a drive mechanism (not shown), the drive mechanism preferably being in communication with a controller (not shown) for controlling operation thereof during a filling sequence.

Referring now to FIGS. 4–18, the sanitary pump 10 in accordance with the invention a pump mechanism 10 mechanically driven by a motor 28 for delivering a viscous liquid material L under pressure to a plurality of sanitary fill valves 510 via the manifold M, the pump mechanism 10 typically generating a pulsating output during a filling cycle or sequence.

The sanitary pump 10 includes a substantially cylindrical housing 12 for accommodating a double acting piston head 14 driven by a drive shaft 16 disposed in substantial axial alignment with the cylindrical housing 12. The interchangeable, removeable and detachably sealable cylindrical plates 18 and 20 are provided to close the ends of the substantially cylindrical housing.

Figure 4:
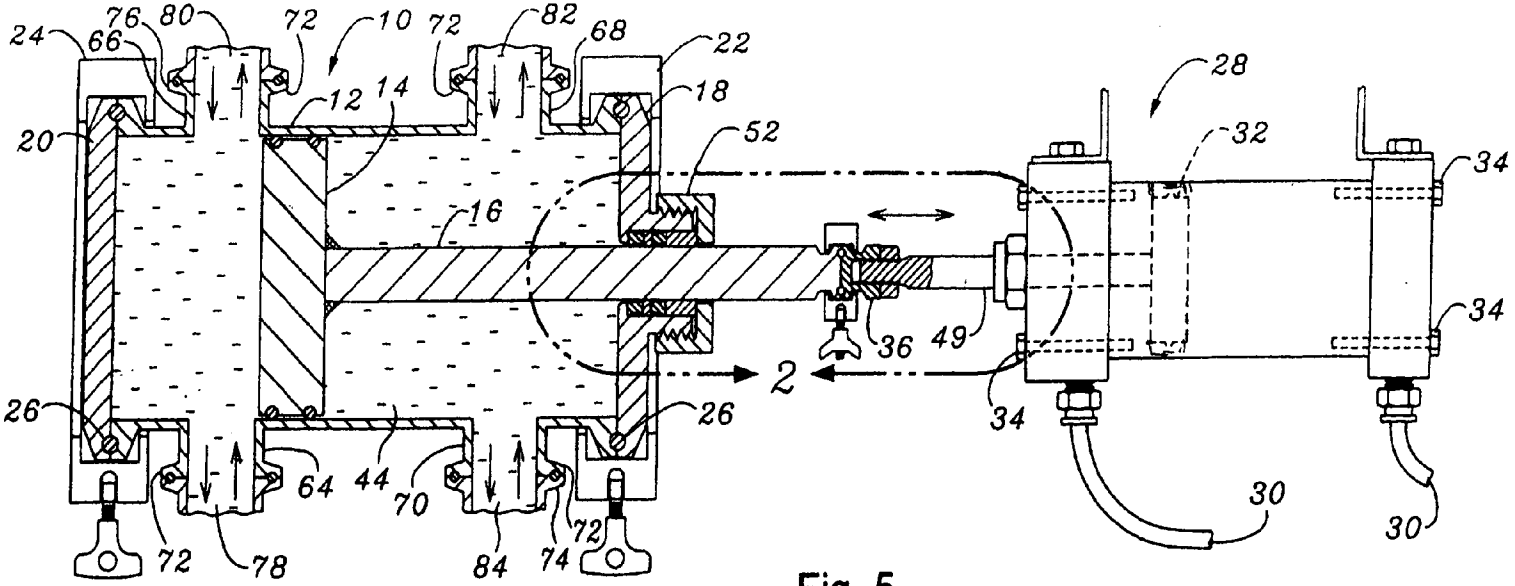
FIG. 4 is a side elevational view partly in section illustrating the sanitary pump of the invention.
Figure 5:
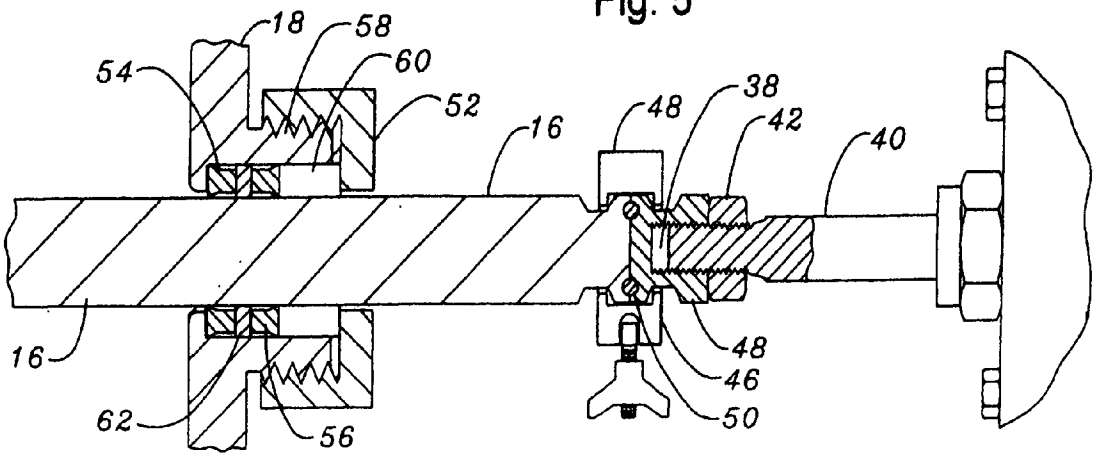
FIG. 5 is an enlarged view of the sanitary pump along reference line 2—2 illustrating a portion of the drive shaft and sealing arrangement of the sanitary pump.

Interchangeable, removeable and detachably cylindrical plates 18 and 20 are secured to the substantially cylindrical housing 12 in the preferred embodiment by removeably detachably clamps 22 and 24 which may be flange clamps or tri clover clamps to seal the ends of the substantially cylindrical housing by means of O-rings 26. The interchangeable, removable and detachably sealable cylindrical plates 18 and 20 are preferably utilized so that plate 18 may be placed on the opposite end of substantially cylindrical housing and plate 20 may be placed at the opposite end of cylindrical housing 12 to allow drive motor 28 to drive shaft 16 of the sanitary pump from the left side as opposed to the right side as illustrated in FIG. 4.

Drive motor 28 can be any type of motor to provide reciprocal motion for driving drive shaft 16 reciprocally within housing 12. In the preferred embodiment, drive motor 28 is a pneumatically activated having air inlets 30 and corresponding air outlets (not shown) for driving piston head 32. Drive motor 28 may include means for adjusting the reciprocal travel provided for drive shaft 16 such as adjustment screws 34 or adjustment valves for adjusting the length of stroke of drive motor 28. In addition to adjustment means 34 on drive motor 28, various other types of adjustment means for changing the length of the stroke of drive shaft 16 may be utilized such as linkages, levers and others mechanical means for adjusting the length of the stroke of drive shaft 16 which can be calibrated to adjust the travel of double acting piston head 14 within substantially cylindrical housing 12. In addition to adjustment means 34 for adjusting the length of the stroke of motor 28, a further adjustment means 36 is provided at the end of drive shaft 16. The adjustment means 36 provided on drive shaft 16 may include a threaded opening 38 into which threaded shaft 40 of drive motor 28 may be adjusted by the utilization of adjustment nut 42. The motor 28 and/or the adjustment means 34, 36 may be provided with a controller (not shown) for the positive automated control of the operation of the sanitary pump 10 during a filling operation in accordance with certain operation parameters that occur before or during the filling operation.

Adjustment means 36 alone or in combination with an adjustment means 34 on drive motor 28 is designed to control the exact position of double acting piston head 14 in cylinder 44 to assist in precisely metering fluids pumped by the sanitary pump. In sanitary pump applications, a clamp 46 is designed to connect drive shaft 16 to a threaded shaft 40 of shaft 49 by a nut 48 having a threaded opening 38. Nut 48 is held in place by clamp 48 with an O-ring seal 50.

The sealing arrangement for sealing drive shaft 16 within interchangeable, removeably and detachably sealable cylindrical plate 18 includes a compression nut 52 for compressing the seals 54 and 56 against drive shaft 16. Compression nut 52 is adjustably secured to plate 18 by threads 58 to provide for the compression of bushing 60 against seals 54 and 56, as well as a compression washer 62 disposed between seals 54 and 56. Seals 54 and 56 are preferably a loaded lip seals or seals that have a lip on it such as cap seals, V-ring seals, quad seals or other types of O-ring seals having a flat surface to provide for a compression and wiping against shaft 16. The combination of a loaded lip seal together with compression nut 52 provides a tight reliable seal, which may be augmented by a drive shaft stabilizing device, as will be described hereafter in greater detail.

Figure 6:
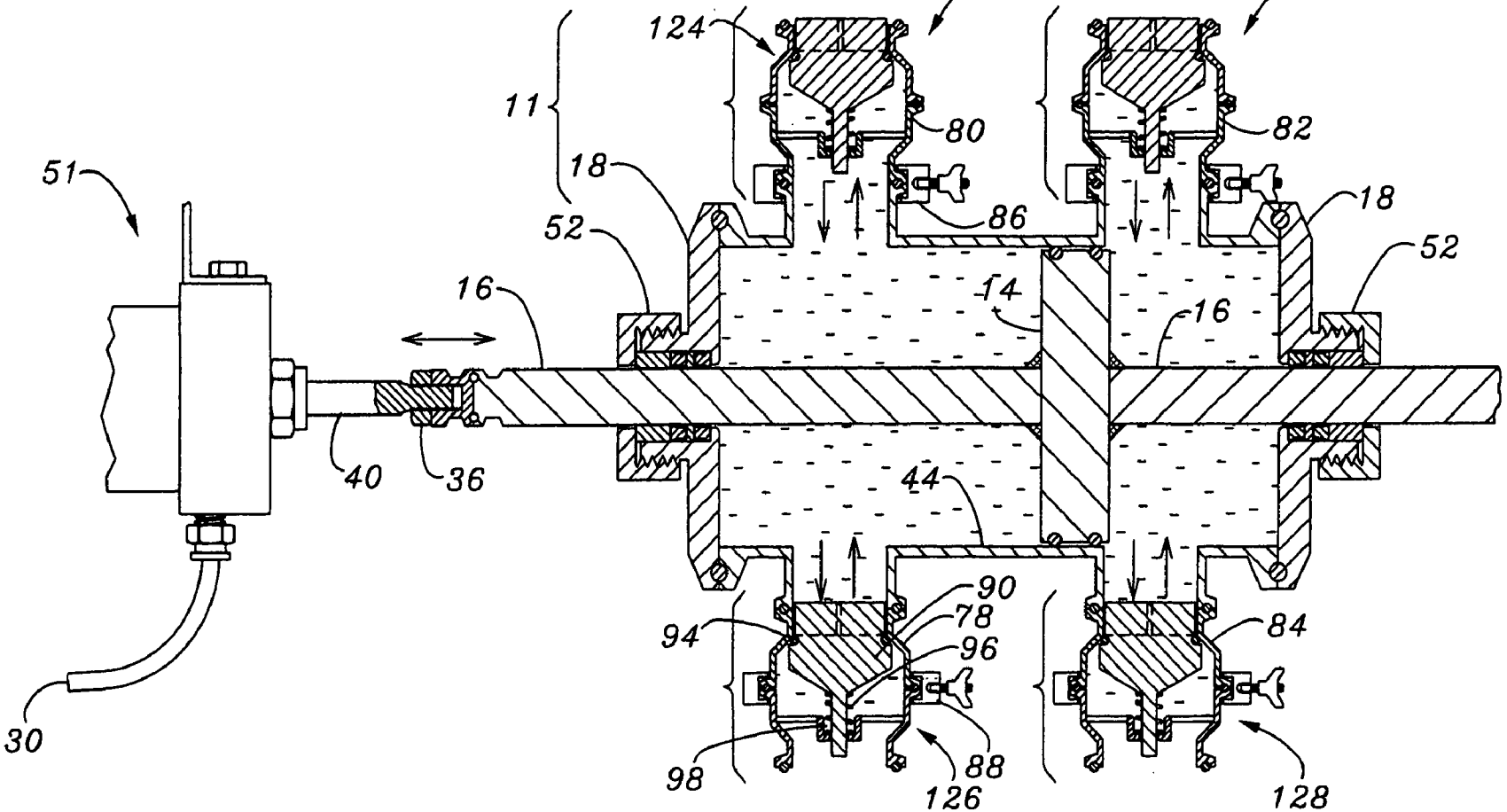
FIG. 6 is an alternative embodiment of the sanitary pump of FIG. 4 including a dual drive shaft and associated detachable sanitary check valves of the sanitary pump.

An alternative embodiment of the invention is illustrated in which drive shaft 16 has been extended in both directions from double acting piston head 14 and interchangeable, removeable, detachably sealable cylindrical plate 18 has been utilized on the seal both ends of cylinder 44. The advantages of the alternative embodiment as illustrated in FIG. 6, include the fact that drive rod 16 can be either driven from the left side, as shown in FIG. 6, or from the right side by utilizing a drive motor 28. The alternative embodiment as illustrated in FIG. 6 further allows the volume on both sides of double acting piston head 14 to be substantially the same or equalized to assist in the precise pumping and metering of dispensed fluids. The positive control over drive shaft 16 by drive motor 28, and hence piston head 14 is markedly different than the prior art since the sanitary pump maintains positive control over the pumped viscous liquid material L and does not depend upon the physical characteristics over the pumped viscous liquid material L such as density and compressibility of the dispensed viscous liquid material to provide an accurate pumping and metering of the dispensed viscous liquid material L.

Referring again to FIGS. 4–7 the substantially cylindrical housing 12 includes a pair of inlet/outlet ports 64 and 66 disposed on one side of piston head 14 and a second pair of inlet ports 68 and 70 on the other side of piston head 14. The provision of a pair of inlet and outlet ports, in combination with check valves as will be described hereinafter allows the sanitary pump to efficiently pump fluid without entrapping air and to reduce turbulence and cavitation to substantially eliminate frothing and/or other physical disturbances of pumped fluid that would otherwise detract from the metering capabilities of the sanitary pump.

The inlet/outlet ports 64, 66, 68 and 70 in sanitary pumps terminate in flanges 72 for accommodating a similar flange 74 for sealing with an O-ring 76. The flanges 72 are designed to accommodate a corresponding flange on a detachably separable check valve housing 78, 80, 82 and 84. The detachably separable check valve housing are held in place by clamps 86 and 88 and sealed by O-ring 76.

As illustrated in FIGS. 6–14, the components of the detachably separable check valve housing 78, 80, 82 and 84 in the sanitary pump 10 is illustrated. Each of the detachably separable check valve housing 78, 80, 82 and 84 are interchangeable and may be rapidly and quickly removed and disassembled or replaced on the sanitary pump 10. The detachably separable check valve housing 78 can be taken apart by removing a flange 88 to disassemble or replace the components of check valve 90. The check valve is constrained within a separable lower check valve housing 92 that includes upper and lower valves sealed by an O-ring and held together with flange clamp 88. The check valve 90 includes at the lower end an O-ring seal 94 and at the upper end a spring 96 captured within a cavity 98 disposed within check valve guides 100 housed by detachably separable check valve housing 78. O-ring seal 94 on the check valve seals and protects the seal area. In the preferred embodiment of the invention check valve guide 100 may be removed from detachably separable check valve housing 78 for cleaning.

The configuration of the check valves 90 is best illustrated in FIGS. 11–14 which illustrate the arrangement of the check valve in open position and closed position for the sanitary pump 10. One half of the check valve housing 78 terminates in a flange 101 with a groove for an O-ring 102 for mating with a similar flange and groove on sanitary pump housing 12. As heretofore indicated, a flange clamp 88 is used to connect the two halves of the detachably separable check valve housing 78 to each other utilizing flanges 104 and an O-ring 95 housing 78 to the sanitary pump 10. Separable check valve housing 102 is designed to closely fit around the bottom check valve seat 106 of check valve 90 so that when check valve 90 is in an open position the constraining walls of the separable check valve housing 92 are designed as a guide to limit radial movement and maintain check valve 90 in a radially constrained position. The lower guide in limiting radial movement cooperates with spring 96 which as the spring compresses into cavity 98 guides the check valve stem into cavity 98 along with spring 96 and together with constraining walls 108 and check valve seat 106 holds the check valve in axial alignment so as to prevent wobbling or radial movement which otherwise destroys or prevents the check valve from operating in a high speed environment such as is required for check valves operating around or above 200 cycles per minute and generally in a range from 60 to 160 cycles per minute.

The check valve stem guide support 100 also includes a tight collar 110 for maintaining and guiding the stem of check valve 90 in a substantial axial position. The thickness of collar 110 can also be utilized to assist in maintaining the check valve in substantial axial alignment. The check valve stem guide support 100 also includes vanes 112 which allow materials to move through the check valve as illustrated by arrows 114. The check valve seat 106 also includes vanes 118 and openings for allowing fluid to pass around and through the sides of bottom stem 106 as illustrated by arrows 120.

Figure 7:
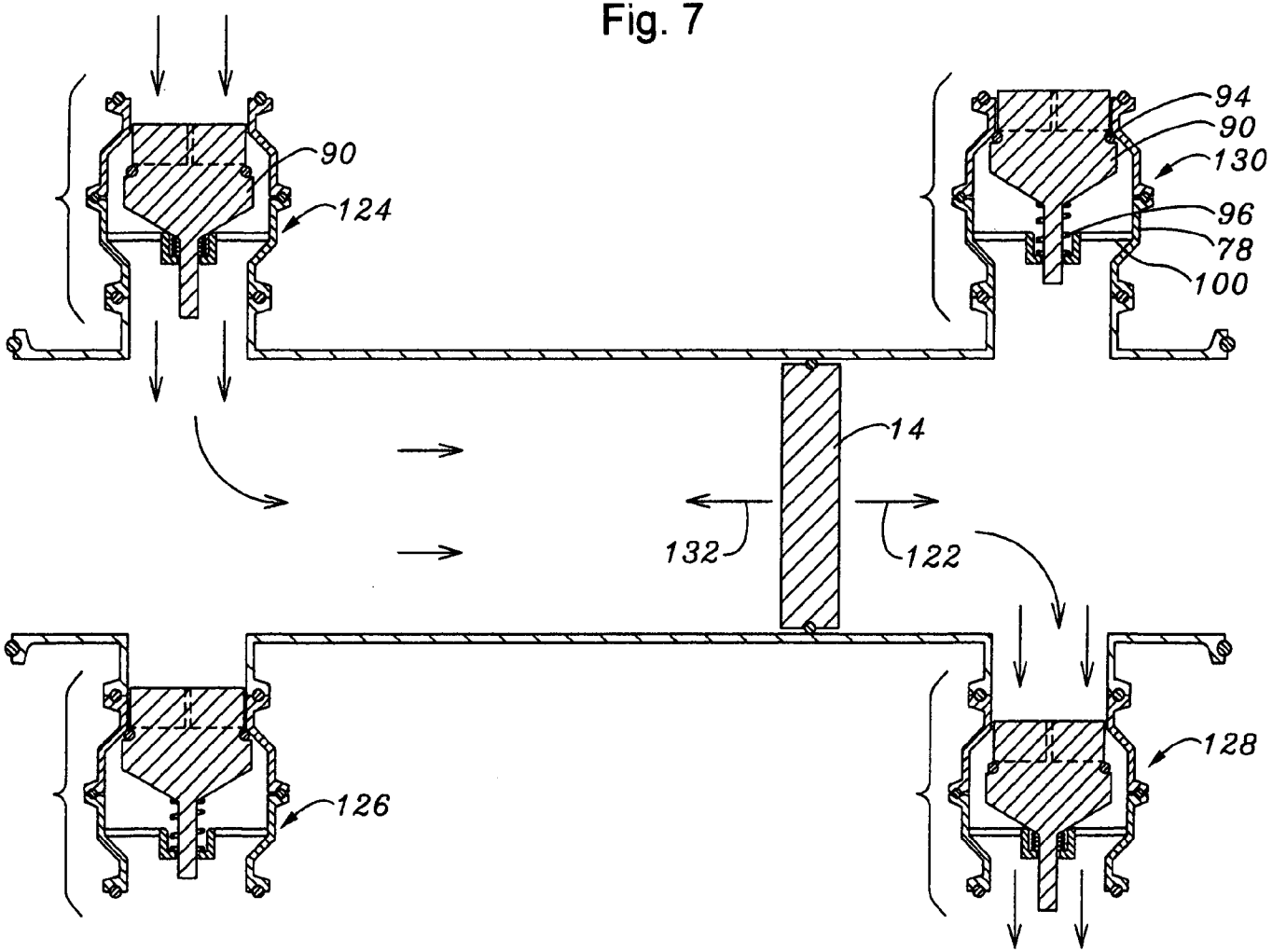
FIG. 7 is a side cut-away diagrammatic view of the operation of the check valves in relation to the piston head.
Figure 9:
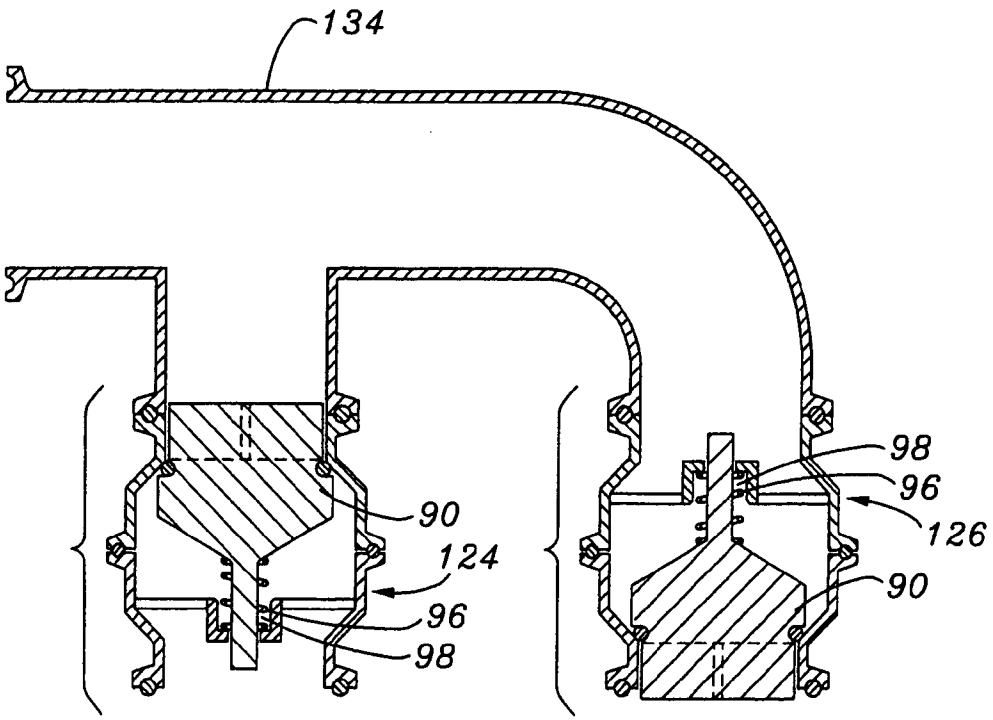
FIG. 9 is a pair of check valves disposed in a manifold of the sanitary pump.
Figure 8:
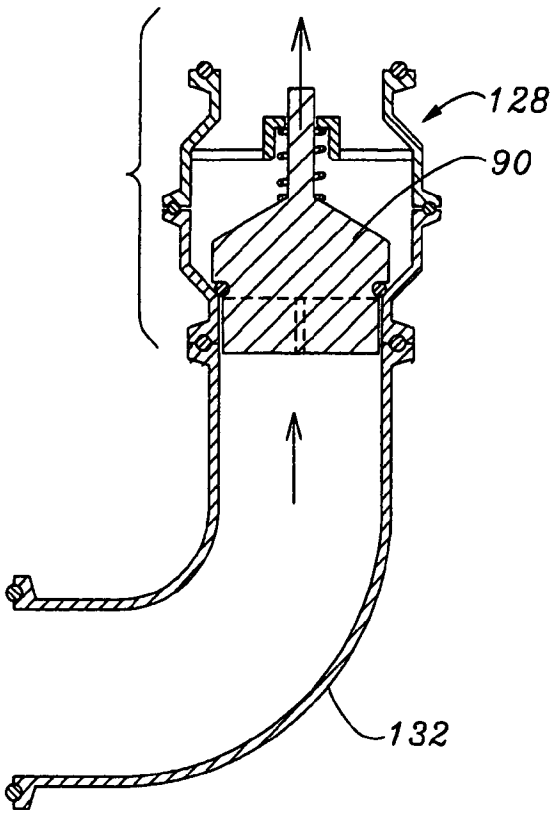
FIG. 8 is a cross-sectional view of a check valve in a manifold of the sanitary pump.
Figure 10:
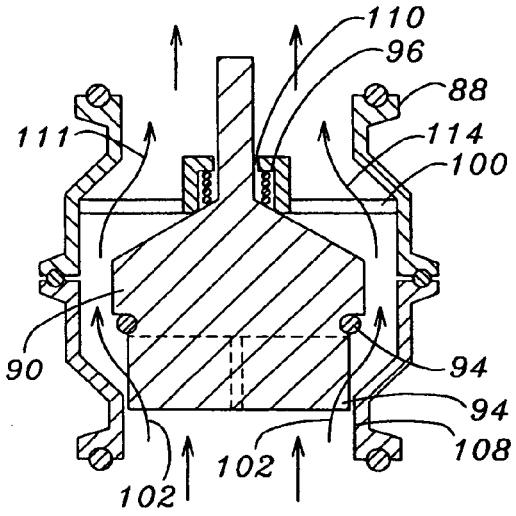
FIG. 10 is a cross sectional view of the sanitary check valve of the sanitary pump in a closed position.
Figure 11:
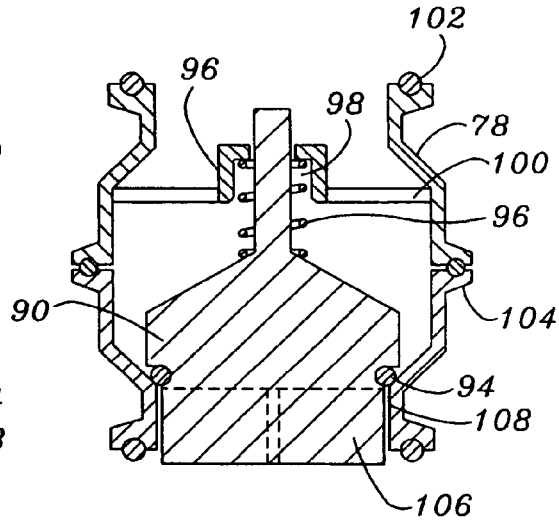
FIG. 11 is a cross sectional view similar to FIG. 10 illustrating the sanitary check valve in an open position.
Figure 12:
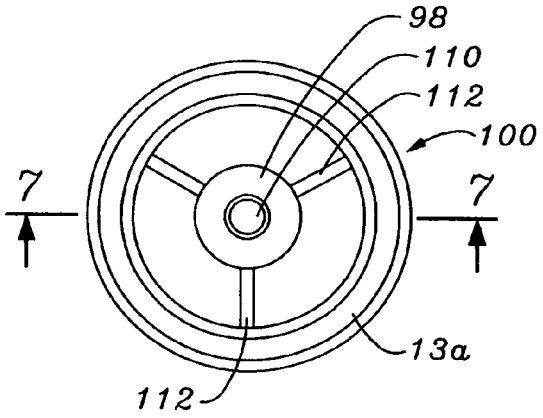
FIG. 12 is a bottom plan view of the valve stem guide of the check valve of FIG. 10.
Figure 13:
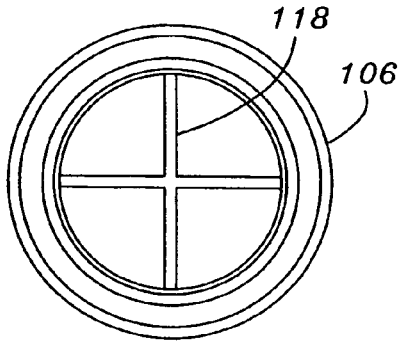
FIG. 13 is a bottom plan view of the check valve seat of FIG. 10.
Figure 14:
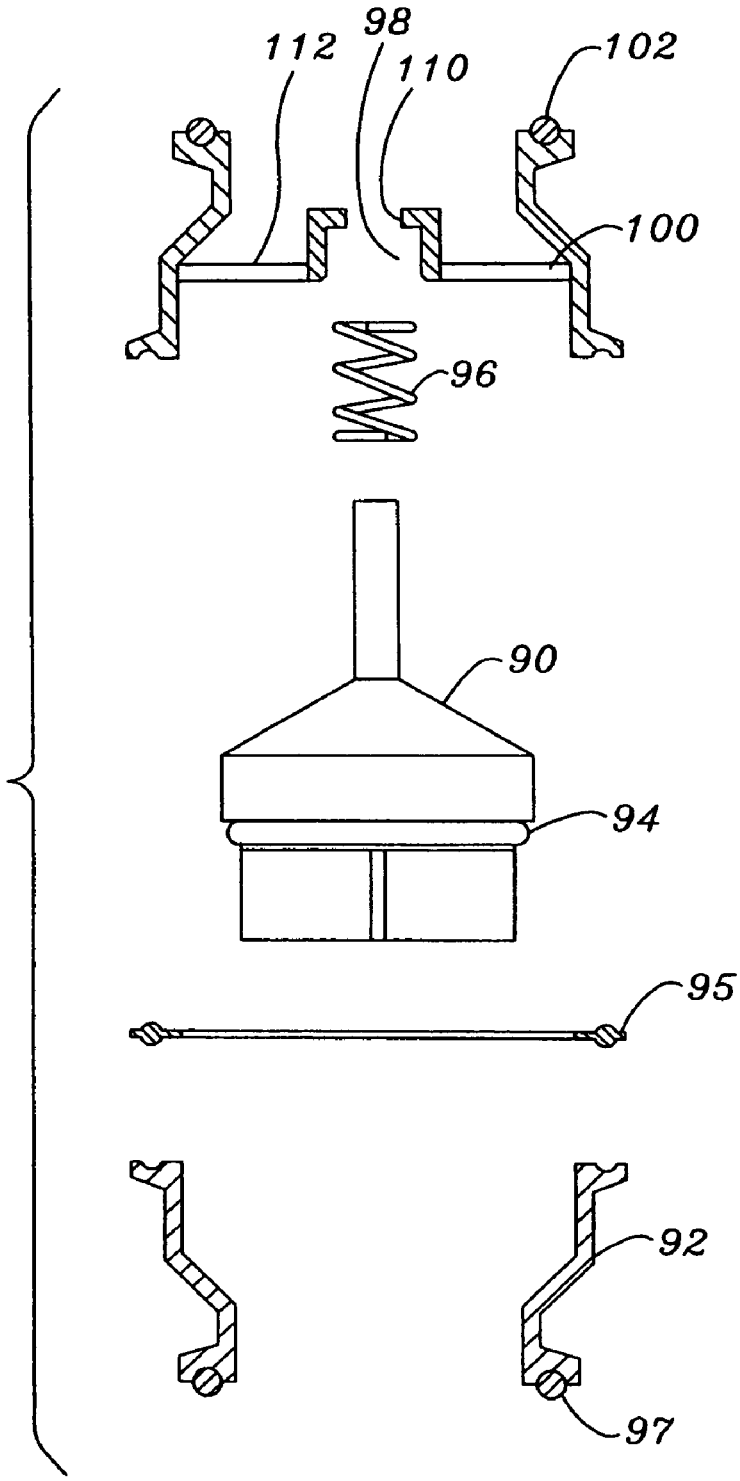
FIG. 14 is an exploded view of the sanitary check valve of FIG. 10 of the sanitary pump.
Figure 15:
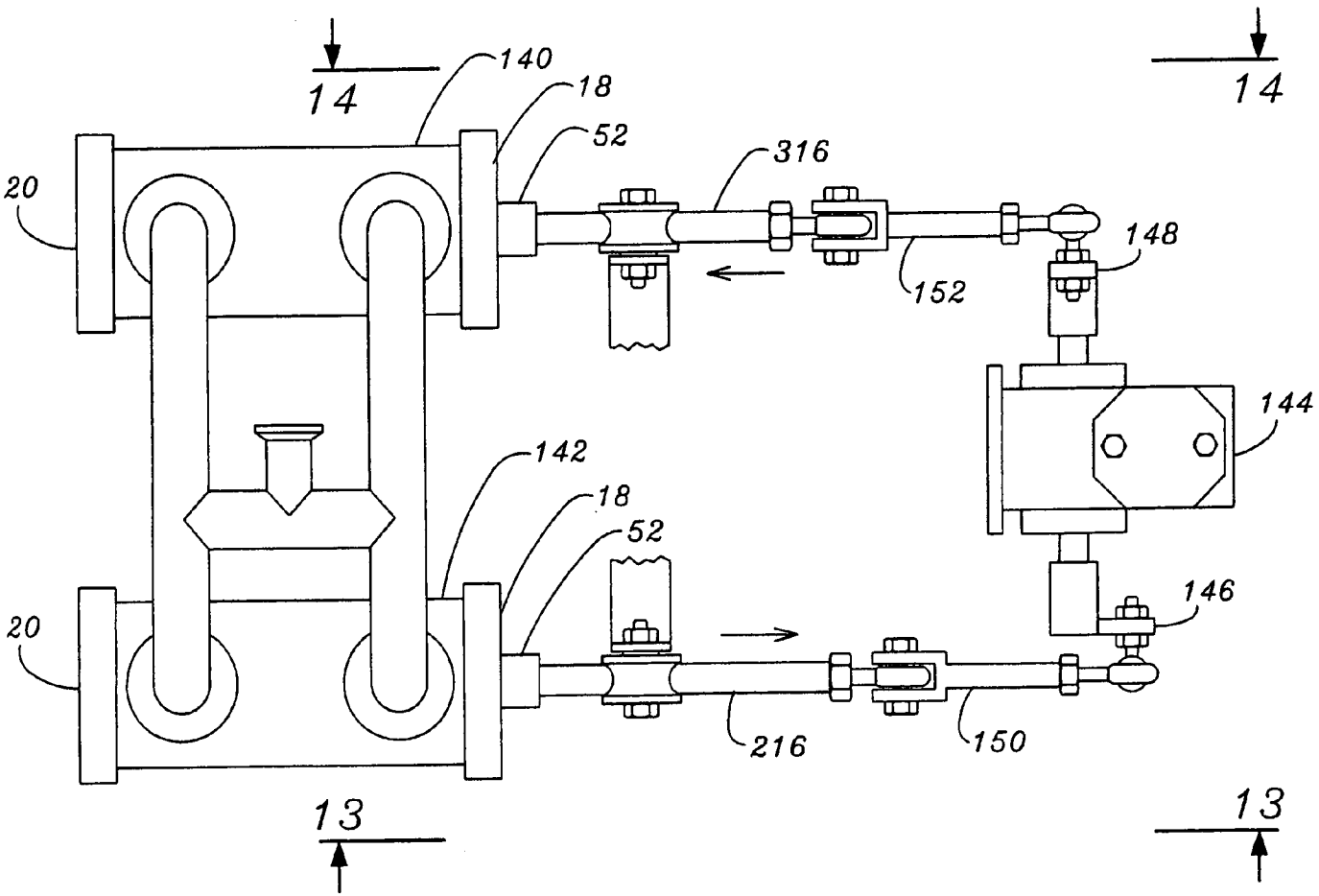
FIG. 15 is a top plan view of a pair of sanitary pumps disposed in a parallel pumping arrangement activated by a single 16 drive motor.
Figure 17:
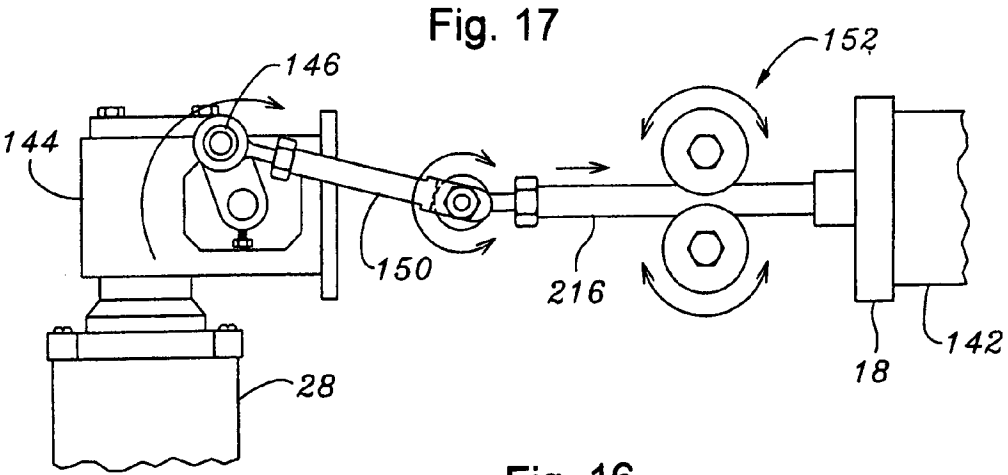
FIG. 17 is a portion of the sanitary pump and drive motor arrangement illustrating a stabilizing means for the drive piston of the constant pressure pump.
Figure 16:
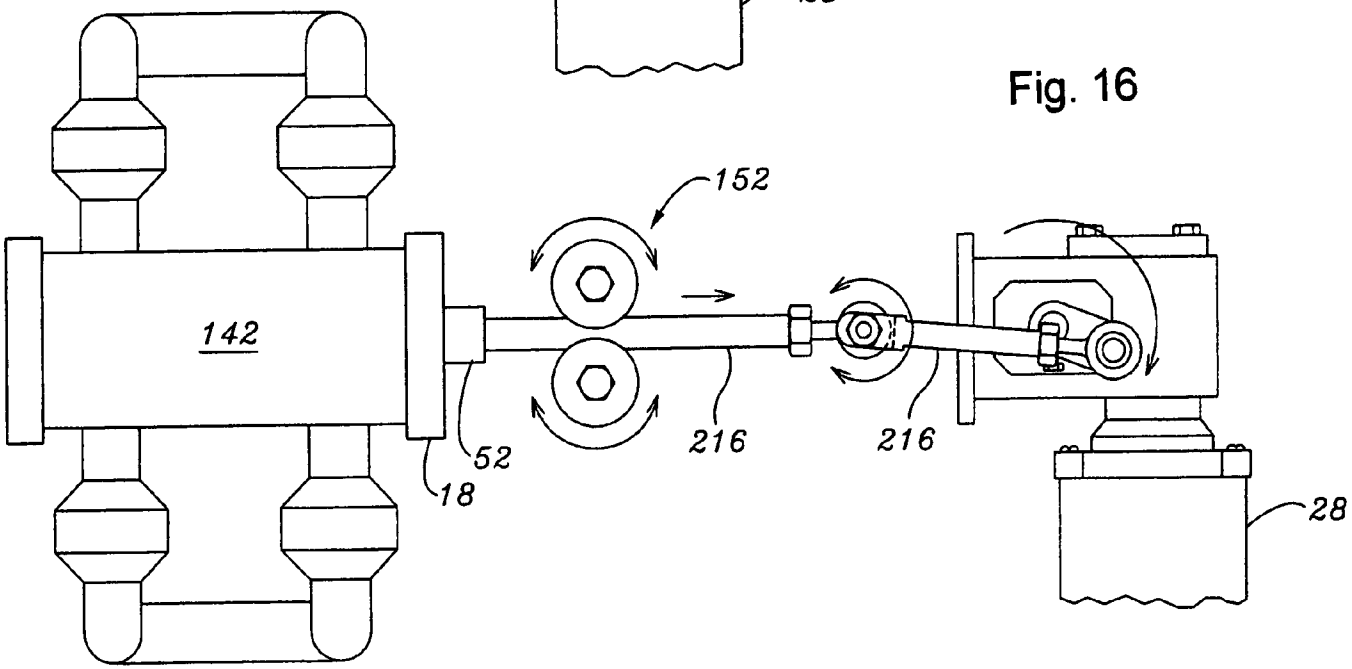
FIG. 16 is a side elevational view of FIG. 15.

The operation of the check valves in the sanitary pump is best illustrated in FIGS. 6–9 and particularly FIG. 7 in which movement of piston 14 in the direction of arrow 122 causes outlet check valve 128 to open and forces inlet check valves 130 to close. At the same time, the action of double acting piston 14 results in outlet check valve 126 to close and forces inlet check valve 124 to open. Once the stroke of piston head 14 is complete, piston head 14 moves in the direction of arrow 132 causing outlet check valve 128 to open and inlet check valve 130 to close while at the same time forcing inlet check valve 124 to close and outlet check valve 126 to open. The motion of piston head 14 is positively controlled by drive shaft 16 to positively maintain control over viscous liquid materials L entering and exiting the sanitary pump 10 without the necessity of relying upon compressibility of the viscous liquid material L to drive piston head 14.

The fact that piston head 14 is positively controlled is of significant advantage in not having lead and lag time in operation as it does not rely upon compressibility of the viscous liquid material L for operation, a much greater control is maintained over the viscous liquid materials L pumped by piston head 14. In addition, the positive control over piston head 14 by drive shaft 16 in combination with the check valves 90 eliminates frothing and undue turbulence imparted to the dispensed viscous liquid materials L imparted by feed or dosing pumps to more precisely control and meter dispensed viscous liquid materials L where precise metering is desired. In most filling operations a separate feed of dosing pump is not required. As will be recognized, the operation of the double acting sanitary pump 16 provides a constant pressure pump for dispensing viscous liquid materials L in filling and transferring fluid operations.

The sanitary pump in accordance with the invention may be configured in a variety of configurations with right drive and left drive operations as well as the provision for tandem and parallel applications of the sanitary pump. These configurations and applications of the sanitary pump 10 by way of illustration included in FIGS. 15–17 in which a single drive motor 28 is provided to drive two sanitary pumps, 140 and 142 in a parallel application for increased capacity. Drive motor 28 drives a gear box 144, which is a prior art gear box, such as is available from Leeson Electric Motor of Grafton, Wis. for driving the two sanitary pumps 140 and 142. Gear box 144 includes a pair of crank mechanisms 146 and 148 for driving adjustable linkages 150 and 152 adjustably connected to two drive shafts 216 and 316 of sanitary pumps 140 and 142. In such operations the provision of stabilizing means 152 is provided to stabilize drive shafts 216 and 316 to prevent undue lateral movement and wear on seals 54 and 56 in interchangeably removeable and detachably sealable cylindrical plates 18. Stabilizing means 152 may include confronting wheels 154 and 156 for maintaining drive shaft 216 in a substantial fixed radial position while drive piston 216 reciprocates axially within cylinder 44 of cylindrical housing 12 of sanitary pump 142.

Figure 18:
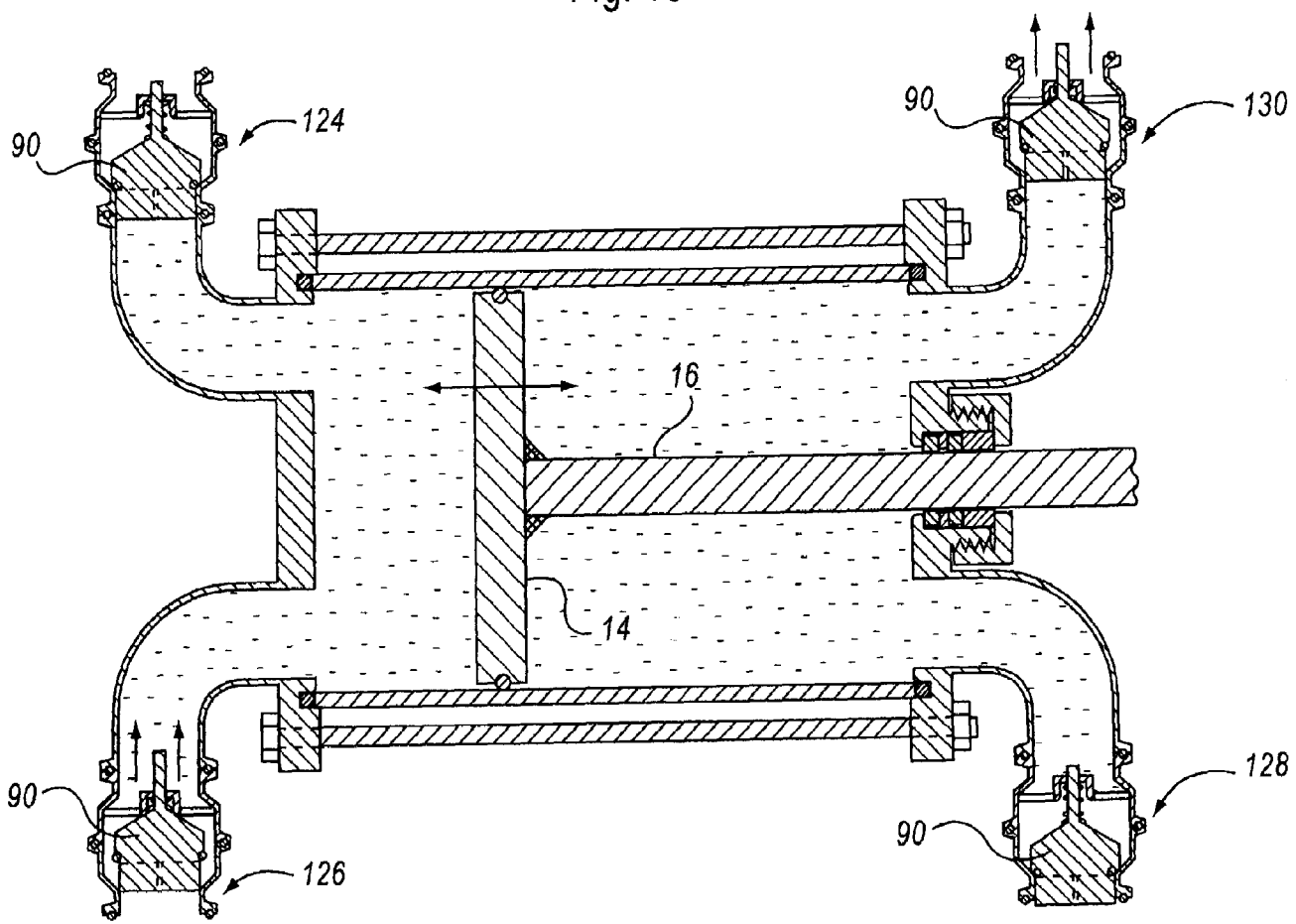
FIG. 18 is a further embodiment of the pump illustrating an alternative arrangement of check valves and ports disposed in endplates of the pump.
Figure 19:
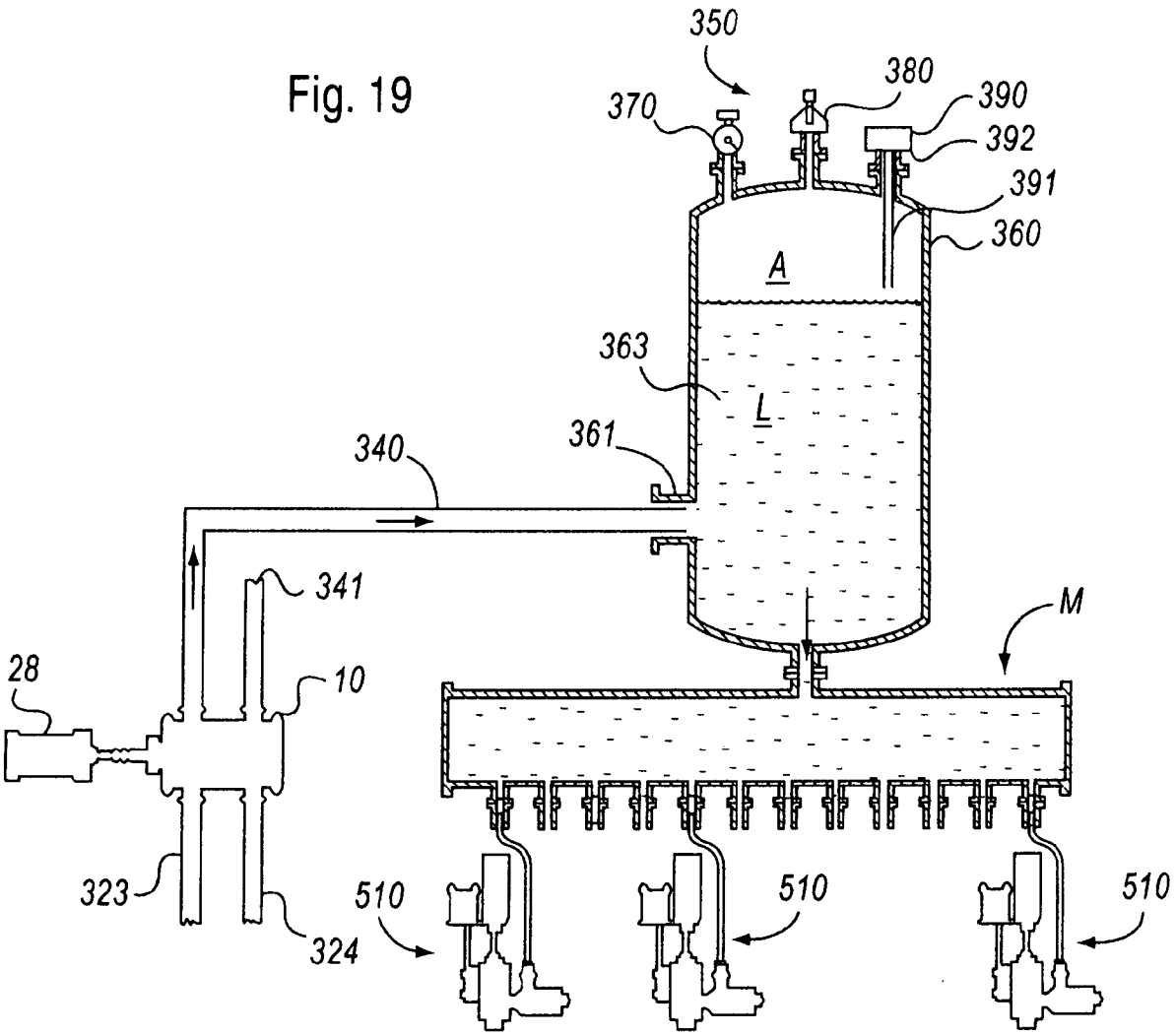
FIG. 19 is a side elevational view partly in section of the pump delivery apparatus adapted in accordance with the invention.

As will be recognized by those skilled in the art the sanitary pump 10 may be modified in a number of ways to suit particular applications. One or both inlet and outlet ports disposed in the interchangeable and removeably sealable end plates 18 and 20 as illustrated in FIG. 18. The end plates 18 and 20 have been modified to include an outlet port 200 and an inlet port 202 with sanitary inlet check valve 124 and sanitary outlet check valve 126 and sanitary inlet check valve 130. The sanitary pump housing 12 may be closed by removeably sealable end plates 18 and 20 utilizing various fastening mechanisms known in the art such as a plurality of bolts 204 with a plurality of nuts 206. As will be further recognized drive shaft 16 may extend from both sides of piston head 14 and end plate 18 may be used on both ends of cylindrical housing 12 in a configuration similar to the sanitary pump 10 as described with reference to FIG. 6.

The advantages inherent in the sanitary pump 10 of the invention reside in its simplicity of design, interchangeable parts, sealing arrangement for the drive shaft and high speed sanitary and interchangeable check valves 90 which allow the sanitary pump to operate at speeds up to and exceeding 200 cycles per minute utilizing a positively controlled drive shaft. It will be recognized the same advantages in simplicity in design, interchangeability of parts and the rapid disassembly of the components provide for clean-in-place (CIP) advantages required for dispensing viscous liquid material in the food processing and pharmaceutical industry. These advantages of the apparatus are further augmented by the utilization of stainless steel, glass, high density plastic or other material in the fabrication of the pump and components that are compatible with high purity material handling requirements in components substantially free from cracks, seams, threads and other components that would capture and provide breeding surfaces for bacteria or other deleterious substances. These same clean-in-place and disassembly advantages allow the sanitary pump 10 and sanitary valves 90 to be disassembled and transported easily to remote locations and set up for pumping operations in either sanitary or non-sanitary environments or applications where reliability, high pressure, high flow and particularly a constant pressure pump is desired.

The sanitary pump 10 of the invention may be configured and implemented in a number of ways to achieve the advantages of a constant pressure reliable pump having high capacity, high reliability and easily detachable and easily assemblable components for a variety of configurations and operations. It will be recognized that the sanitary pump can be utilized in non-sanitary application where the end plates may be threaded into the housing or sealed in various prior art ways in non-sanitary applications. It will be further recognized that the sanitary valves 90 of the sanitary pump 10 may be modified and implemented in a number of different ways to achieve the advantages of the invention.

It will be recognized by those skilled in the art the various modifications and substitutions may be made to suit particular requirements and applications, including right hand drive, left hand drives or the utilization of a drive shaft extending from both ends of the piston head and through the end plate of the constant pressure pump. It will be further appreciated that the size of the pump 10 may be changed to various sizes and shapes to fit particular application and implementation of the invention. It will be understood the inlet and outlet ports of the pump 10 may be reconfigured in a number of ways on the pump housing 12 or on the endplates. It will also be recognized the check valves 90 may be incorporated into or on the pump 10 in a variety of ways and the inlet and outlet check valves 90 may be designed to prevent improper orientation in the sanitary pump 10.

As shown in FIGS. 19–22, the pump pulsation dampening attachment or assembly 350 is provided for substantially dampening any pulsating flow output generated by the sanitary pump mechanism 10. The pump pulsation dampening assembly 350 is preferably disposed in series with the sanitary pump mechanism 10, the viscous liquid material manifold M and the sanitary fill valves 510. In particular, the pump pulsation dampening assembly 350 is disposed in the fluid flow path downstream of the pump mechanism 10 and upstream of the final dispensing destination, i.e., the fill valves 510.

The pump pulsation dampening assembly 350 includes a generally cylindrical pressurized vessel 360 having a sealed inlet port 361 for receiving the viscous liquid material L from the outlets ports 64, 66 of the sanitary pump 10, a sealed outlet port 362 for permitting a flow of the viscous liquid material L into the manifold M, and a control end that includes pressure regulator 370, over pressure relief valve 380, sensing mechanism 390, supplemental dampener/pulse rate indicator 400 and sanitary cleaning mechanism 410. A control valve 364 is provided to permit the transfer of the viscous liquid material L into the fluid manifold M while preventing the back flow of the viscous liquid material L into the vessel 360. It is preferred that the vessel 360 and all components associated therewith is composed of self-lubricating, abrasive-resistant, rust-resistant and hygienic materials. Most preferably, a material such as stainless steel is utilized to form the vessel 360.

The vessel 360 also has an interior surface defining a chamber 363 for receiving the viscous liquid material L from the pump 10. The chamber 363 also contains a certain volume of pressurized air, i.e., an air pocket A therein for absorbing any pulsating fluid flow output generated by the pump 10, to thereby maintain a constant flow of the viscous liquid material L during a filling operation or sequence. Accordingly, the air pocket A inside the chamber 363 behaves as a cushion in absorbing the pulsating fluid flow. Because the intensity level of the pulsations vary between different pump mechanisms, the size of the vessel 360, specifically, the volumetric capacity of the chamber 363, should correspond to the type of pump 10 utilized in the pump delivery apparatus. For instance, because centrifugal pumps cause low intensity pulsations, the volumetric capacity of the chamber 63 should correspondingly be low since less dampening is required. On the other hand, reciprocating pumps generate high intensity pulsations, a chamber 363 having a large volumetric capacity should be used. Accordingly, the pump pulsation dampening assembly 350 of the invention accommodates for a wide-range of pulsation intensities associated with different pumps by providing the vessel chambers 363 with varying volumetric capacities.

Moreover, the desired liquid-to-air ratio provided in the chamber 363 may change depending upon the requirements of the filling operation, which may take into account, the different types of pumps 10 utilized, changes in the liquid viscosity and liquid density, and other factors such as temperature, humidity, etc.

The vessel 360 is sealingly provided with a sensing mechanism 390 for monitoring the air-to-liquid ratio and/or pressure inside the chamber 363, the sensing mechanism 360 being adaptable to produce or otherwise transmit an electronic output signal in response thereto. The sensing mechanism 390 includes a main body 392 with an elongated tube or probe 391 fixedly extended therefrom. During a filling operation, if the level of the viscous liquid material L reaches a height so as to contact the distal end of the probe 391, thereby indicating an impermissible air-to-liquid ratio inside the chamber 363, the sensing mechanism 390 transmits the output signal that is received by the adjustment mechanism 393. Alternatively, the probe 391 may also be equipped with a transducer to enable sensing of the pressure level inside the chamber 363, and in turn transmit a signal to the adjustment mechanism 393 in response to the sensing of an undesirable pressure level. While the drawing figures illustrate the use of a single probe 391, it is apparent to those skilled in the art that the sensing mechanism 390 may employ a plurality of probes 391 to sense the fluid level, the air-to-liquid ratio and/or the pressure inside of the chamber 363. Moreover, the probe 391 may alternatively be adaptable to reciprocate telescopically along its vertical axis to extend further into the chamber 363.

The adjustment mechanism 393 is in sealing communication with the chamber 363 and includes an air source (not shown) and a receiver configured to receive the output signal from the sensing mechanism 390. In response to an indication of an increase in the fluid level, or an otherwise reduction in the air-to-liquid ratio, the adjustment mechanism 393 automatically adjusts the air pressure in the chamber 363 by providing a volumetric increase of air inside therein to a desirable level. To minimize parts of the overall assembly, the sensing mechanism 390 and the adjustment mechanism 393 may be combined to form a single unit that accomplishes the tasks of sensing the fluid, air-to-liquid ratio and/or air pressure in the chamber 363 and making the necessary adjustments in response thereto.

The pressure regulator 370 and over-pressure relief valve 380 are sealingly disposed in communication with the chamber 363. The pressure regulator 370 may be of any type known in the art that is configured to perform within the range of pressures for which is required, and may also have a sanitary design compatible with pharmaceutical or food applications. The over pressure relief valve 380 may be of any type known in the art that is configured to discharge air when the pressure exceeds a desired or permissible level and may also have a sanitary design compatible with pharmaceutical or food applications.

For those applications that require the sanitary filling of viscous liquid material L into containers, the vessel 360 preferably includes a sanitary cleaning mechanism 410 for cleaning-in-place (CIP) the interior surface of the pressurized vessel 360. The sanitary cleaning mechanism 410 includes a conduit 420 having an inlet port for receiving a volume of sanitized fluid from a sanitized fluid source (not shown) and an outlet port disposed inside the chamber 363 for dispensing a sufficient volume of sanitized fluid to facilitate the CIP operation. The outlet port may be provided with a generally circular nozzle head 430 having a plurality of apertures for spraying the sanitized fluid into the chamber 363 and on the interior surface of the vessel 360. The nozzle head 430 may have any geometric shape that permits the effective spraying of sanitizing fluid during a CIP operation. In this regard, the conduit 420 and nozzle head 430 should preferably have sanitary designs that are compatible with pharmaceutical or food applications.

Figure 20:
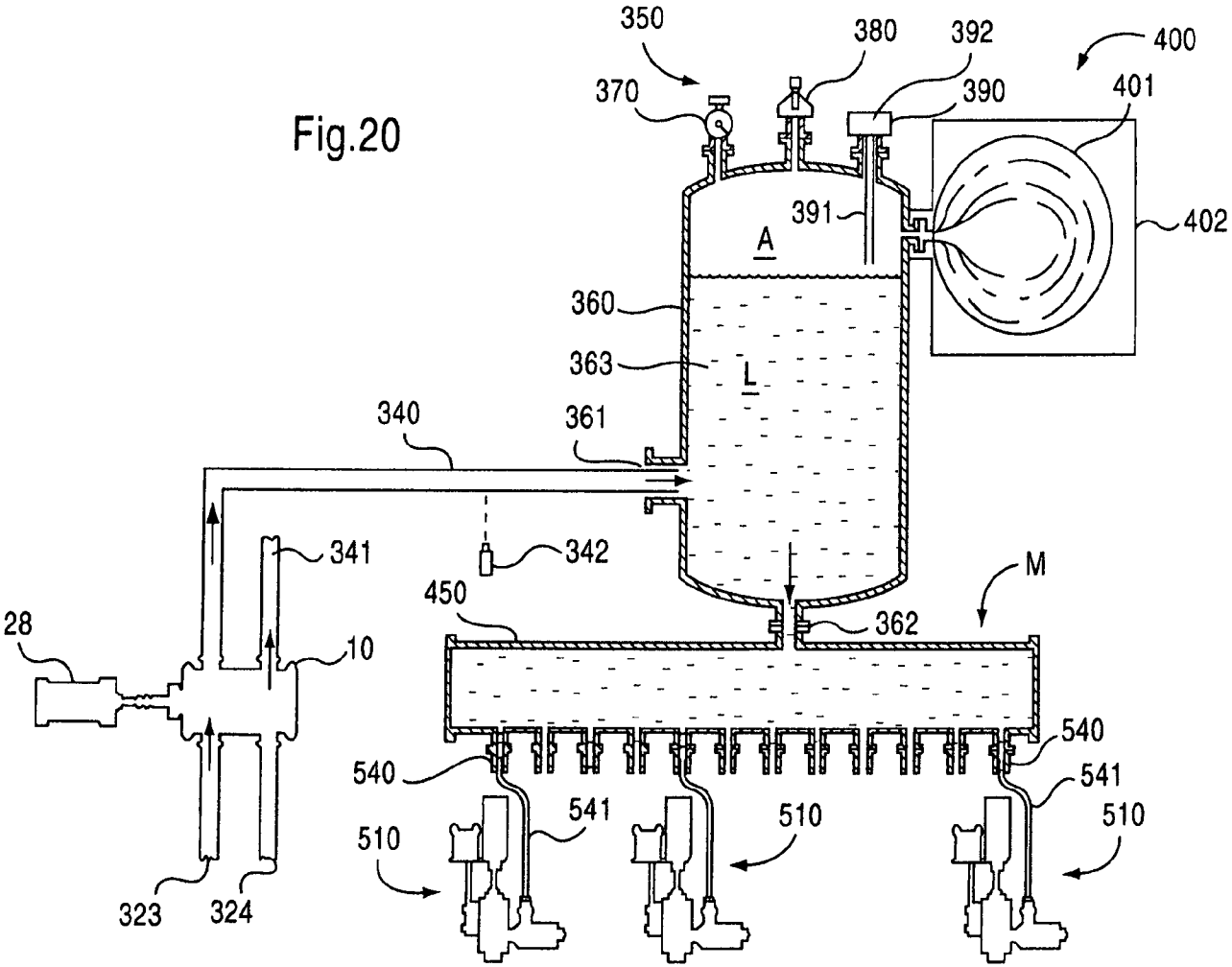
FIG. 20 is a side elevational view partly in section of the pump delivery apparatus adapted for use in a sanitary filling operation in accordance with another embodiment of the invention, the apparatus including a supplemental dampener and pulse rate indicator for absorbing at least a portion of the pulsating output generated by the pump mechanism.

As illustrated in FIG. 20, in order to provide an even effective manner of dampening pump output pulsations during a filling operation, each embodiment of the pump pulsation dampening assembly 350 may further include a supplemental dampener/pulse rate indicator 400 that is placed in communication with the pressurized vessel and which absorbs at least a portion of the pulsating output generated by the pump mechanism 10. The supplemental dampener/pulse rate indicator 400 includes a expandable vessel 401 having an interior chamber in direct fluid communication with the vessel chamber 363 to thereby expand and contract (see hatched lines) in response to the pulsating action of the pump mechanism 10. As an added safety feature to contain the possible event of the expandable vessel 401 going beyond its elastic capacity, the expandable vessel 401 is sealingly enclosed in an expandable container 402. It is especially preferred that the container 402 is composed of a clear translucent material to permit the expandable vessel 401 to be seen by the eye. Such a feature is advantageous in permitting the supplemental dampener/pulse rate indicator 400 to also serve as a visual indicator of the pulse rate of the output from the pump mechanism 10. It is preferable that the expandable vessel 401 is composed of a deformable material having mechanical memory that allows the expandable vessel 400 to maintain its form even in occurrences of large pulsations. It is even more preferable that the deformable material comprises rubber.

Figure 21:
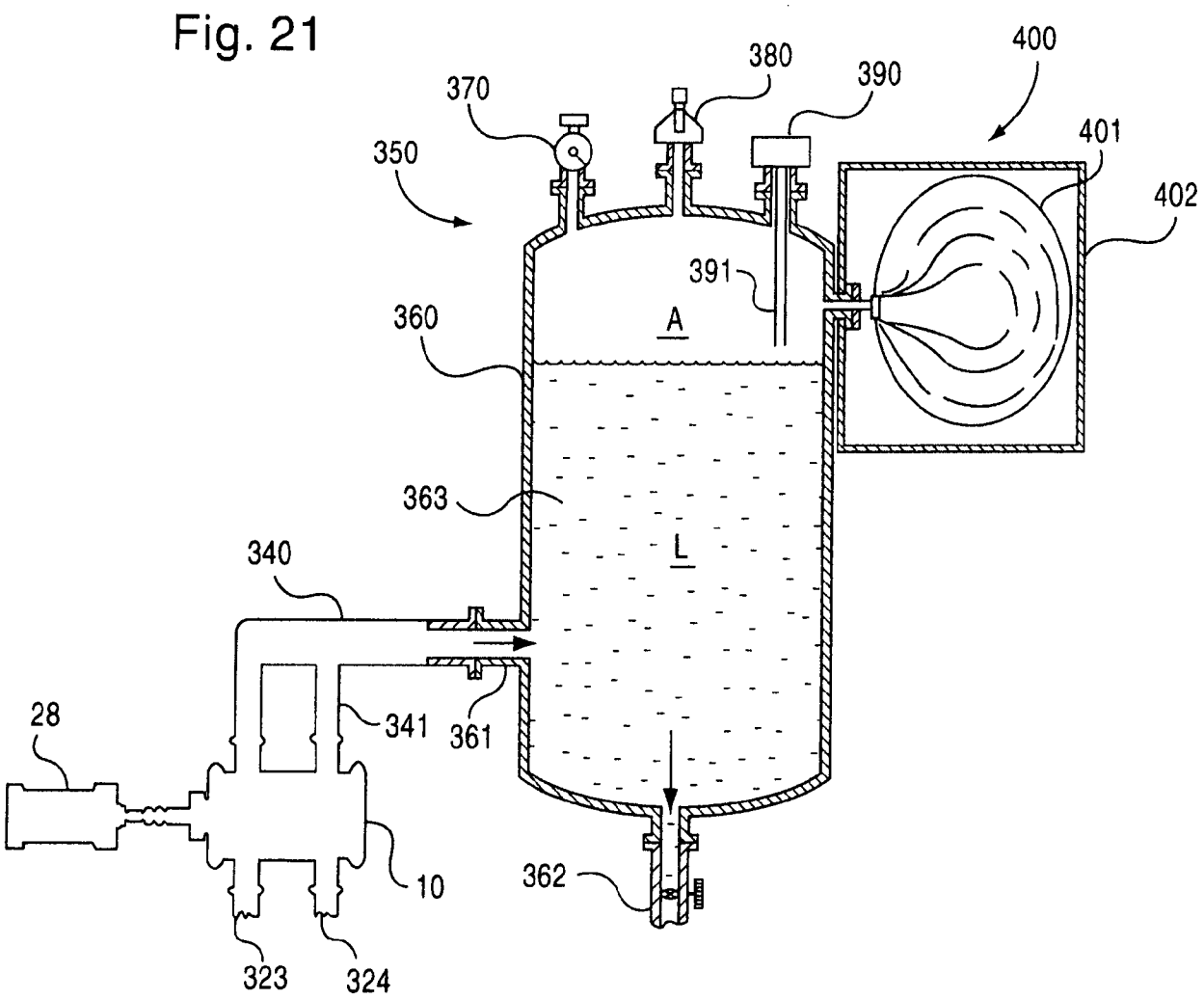
FIG. 21 is a side elevational view partly in section of the pump delivery apparatus.
Figure 22:
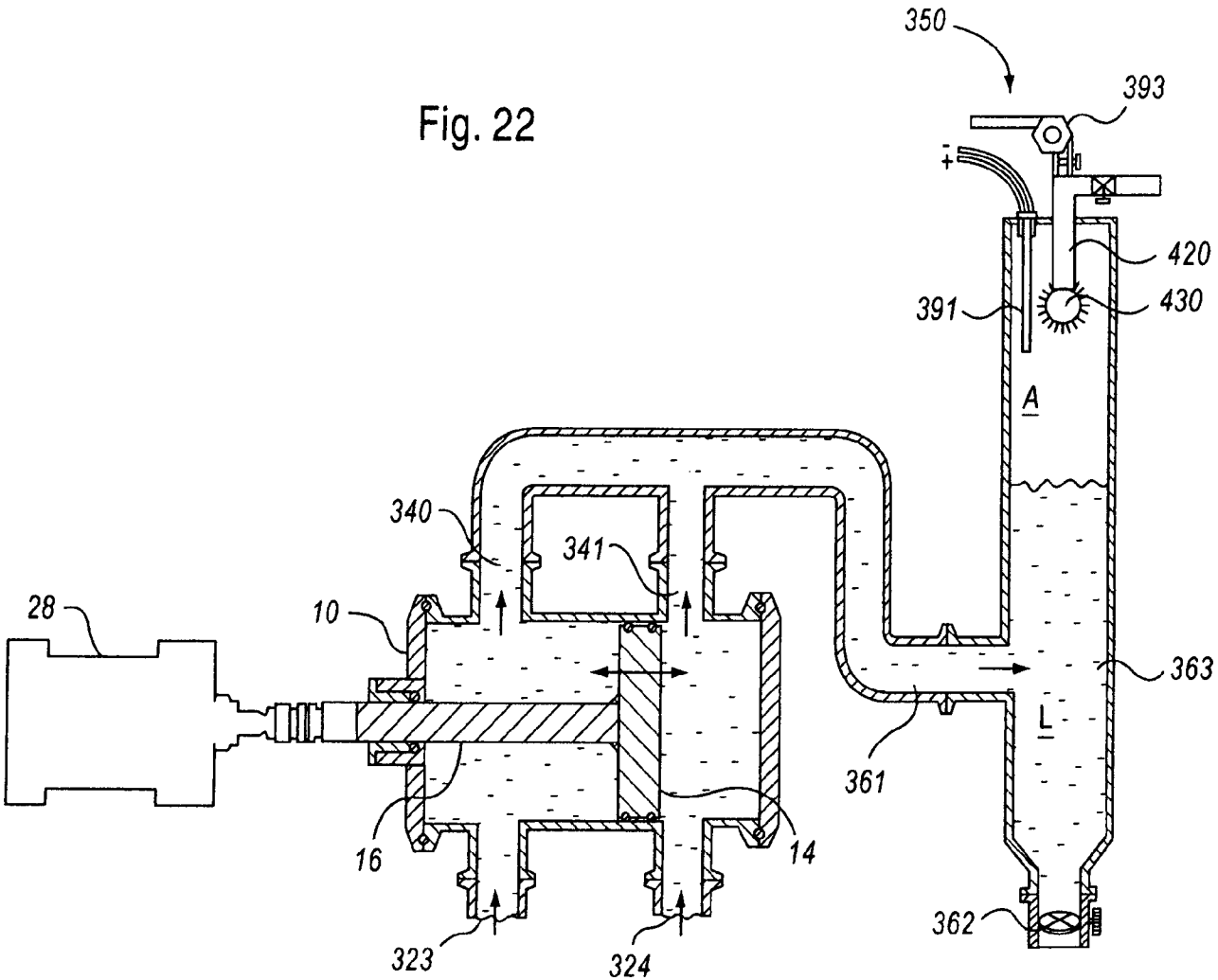
FIG. 22 is a side elevational view partly in section of the pump delivery apparatus adaptable for a double acting piston pump and a pressure vessel configured to accommodate low-intensity pulsations.
Figure 23:
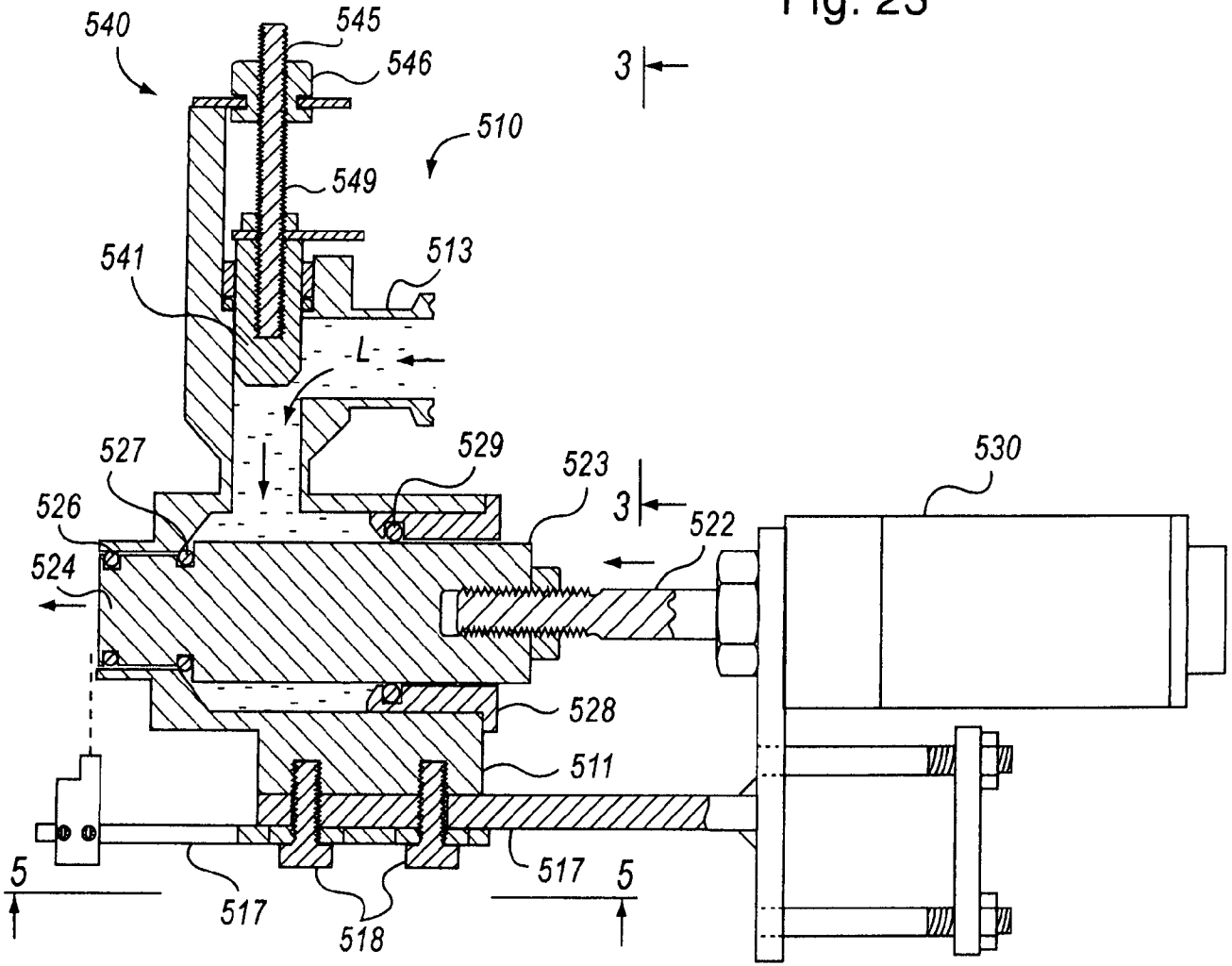
FIG. 23 is a front elevational view partly in section of the sanitary fill valve assembly with the piston in a closed or dispensing position.
Figure 24:
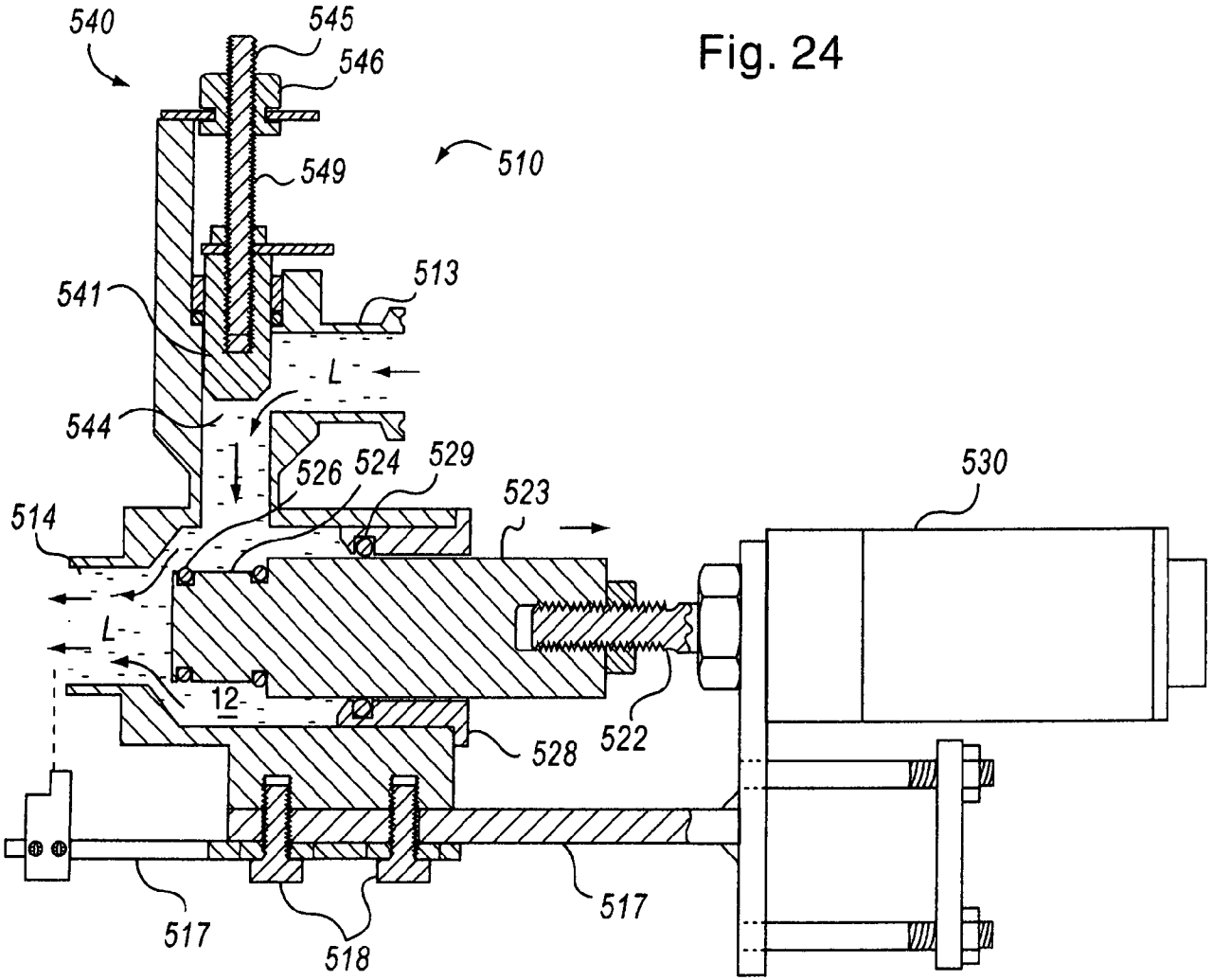
FIG. 24 is a front elevational view partly in section of the sanitary fill valve assembly with the piston in an open position.
Figure 25:
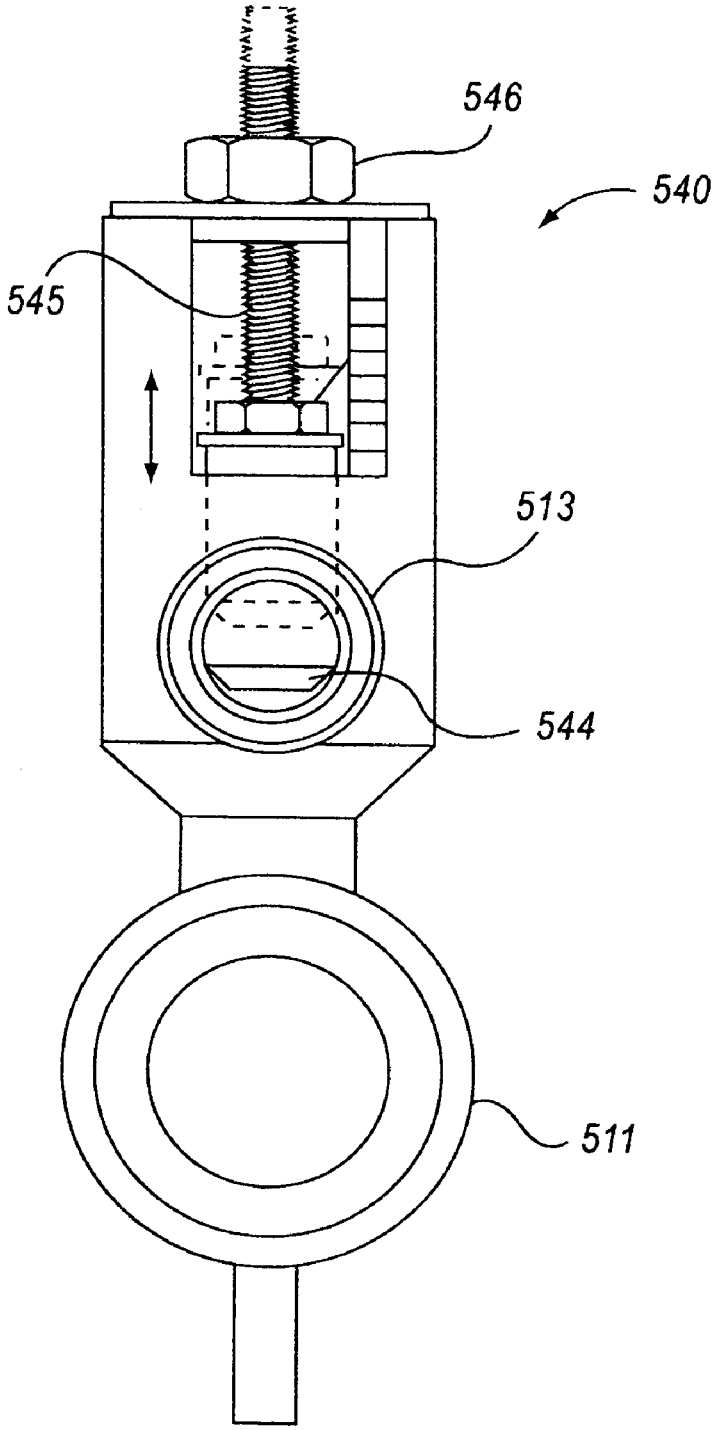
FIG. 25 is a side view of the product regulator taken along line 3—3 in FIG. 23.
Figure 26:
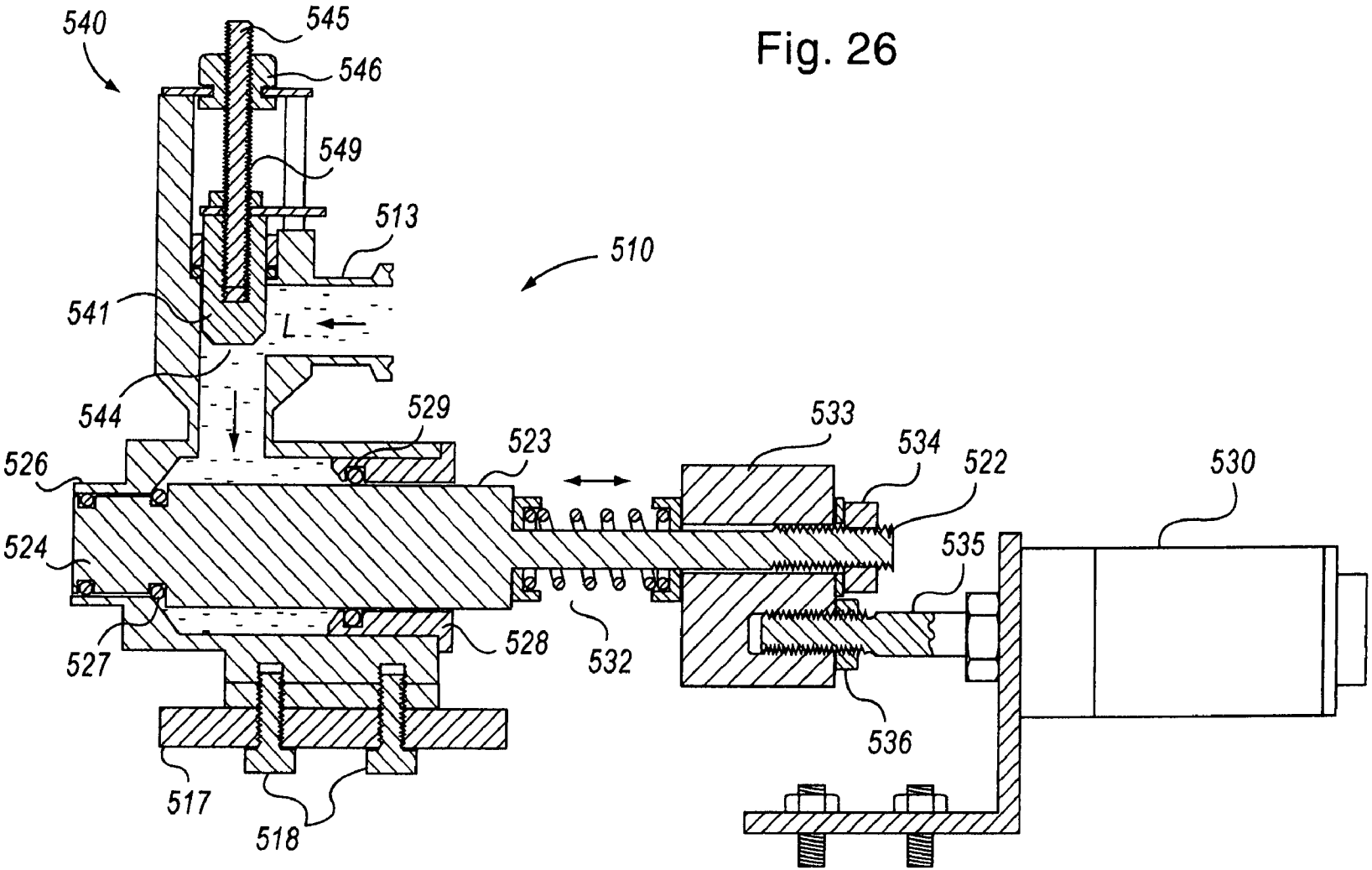
FIG. 26 is a front elevational view of the sanitary fill valve assembly with the piston in a closed or dispensing position in accordance with another embodiment of the invention.
Figure 27:
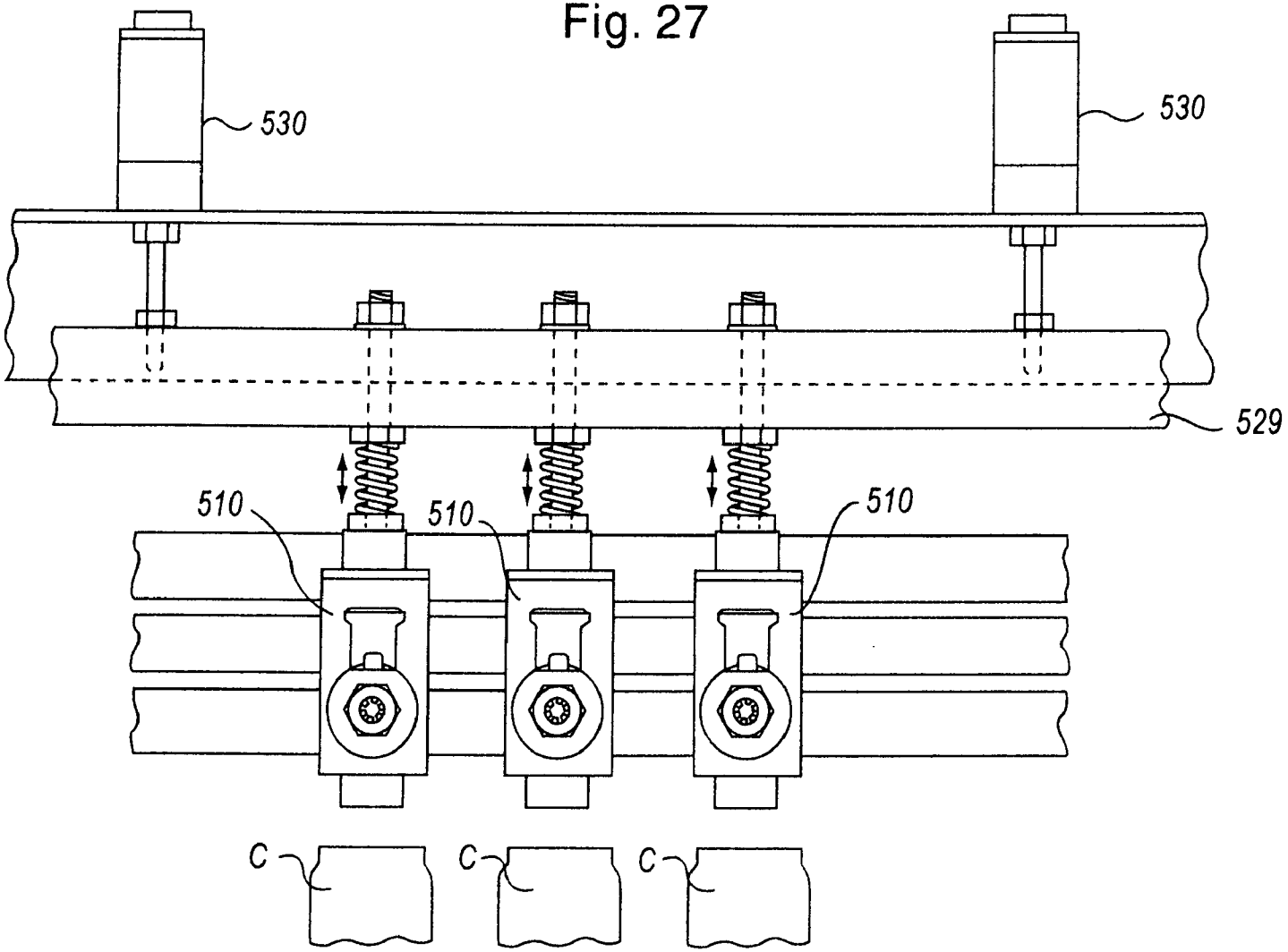
FIG. 27 is a top view of a sanitary in-line filling assembly having a plurality of individually-calibrated sanitary fill valves in accordance with FIG. 27.

Alternatively, as illustrated in FIG. 21, the supplemental dampener/pulse rate indicator 400 may further include a % pair of expandable vessels including an inner vessel 401 in direct communication with the chamber 363 and an outer vessel 403 that surrounds the inner vessel 401 to simultaneously expand an contract in relation to the pulsation output from the pump mechanism 10. It is preferable that each expandable vessel 401, 403 is composed of the same deformable material having mechanical memory. It is even more preferable that the deformable material comprises rubber. It is even more preferred that the rubber used for the inner vessel 401 is of a dark color while the rubber used for the outer vessel 403 is of a clear, translucent type to permit an enhanced visualization of the pulsing action.

The pump pulsation dampening assembly 350 operates by absorbing a volume of the viscous liquid material L during the discharge cycle of the pump 10, while on the suction cycle of the pump cycle, the air inside the dampening mechanism 400 is forced, resulting in essentially smooth flow, thereby enabling the viscous liquid material (L) to continue moving rather than accelerating, decelerating, and stopping. Preferably, the dampening assembly 350 is provided with a controller (not shown) for the precise control of the operation thereof during a filling operation. For instance, the liquid-to-air ratio inside the chamber 363 may be automatically adjusted in accordance with these parameters, control of the supplemental dampener/pulse rate indicator 400 and every component involved in the operation of the pulsation dampening assembly 350.

Accordingly, the pump pulsation dampening assembly 350 is advantageous in providing a pressure delivery apparatus (i.e., the combination of the sanitary pump 10 and the dampening assembly 350) adapted to automatically reduce, minimize, suppress or otherwise dampen undesirable pulsating outputs from the delivery pump, which results in consistent flow rates during fluid delivery, which has the added benefit of reducing production costs and increasing manufacturing output.

The pump pulsation dampening assembly 350 is also advantageous in providing such a sanitary pump delivery apparatus that is adaptable for high-speed capacity pumping operations where constant pressure is desired. The pump pulsation dampening assembly 350 is even further advantageous in providing such a pump delivery apparatus that is adaptable for sanitary filling operations, especially those requiring CIP. The pump pulsation dampening assembly 350 is still further advantageous by varying the volumetric capacity of the vessel chamber in response to the pulsation differences between pump mechanisms.

Referring now to FIGS. 23–28, which illustrates a plurality of ON/OFF sanitary fill valve assemblies 510 in accordance with the present invention which adaptable to simultaneously, rapidly and efficiently deliver or otherwise dispense a precise or uniform quantity of the viscous liquid material L into the interior cavity of a plurality of containers C. Typically, each fill valve 510 includes a fill valve housing 511 adapted to receive the viscous liquid material L from the viscous liquid material manifold M. As best illustrated in FIG. 20, each fill valve 510 is positioned directly beneath the manifold M so as to be in direct fluid communication therewith via a fill valve station 540 and a fluid conduit 541.

A material dispenser 520 is provided for controllably discharging or otherwise dispensing the viscous liquid material L from the fill valve housing 511, including an actuator 530 for driving or otherwise actuating the material dispenser 520. A material flow regulator 540 is also provided for selectively controlling, regulating or otherwise adjusting the rate of flow of the viscous liquid material L to the annular chamber 512' of the fill valve housing 511.

The fill valve housing 511 also includes an inlet passage or channel 513 in communication with the viscous liquid material manifold M for receiving the viscous liquid material L and permitting such viscous liquid material L to flow into the chamber 512. An outlet passage or channel 514 positioned downstream of the chamber 512 is also provided for permitting the dispensing of the viscous liquid material L into a respective container. The viscous liquid material L flows through the valve housing 511 as indicated by the arrows. The inlet channel 513 forms a right-angled elbow to permit flow of the viscous liquid material L into the chamber 512. Thus, the chamber 512, inlet channel 513 and outlet channel 514 are aligned in series to form a flow path through which the viscous liquid material L is received and dispensed. The outlet channel 514 may be configured in a variety of ways depending upon the physical characteristics of the viscous liquid material L. For instance, the outlet channel 514 may include a plurality of channels, the number and size of which are related to the viscosity of the viscous liquid material L.

While the valve housing 511 is shown mounted to the filling apparatus via a plurality of brackets 517 and bolts 518, it is apparent that various fastening devices known in the art may alternatively be used to accomplish this task.

The housing 511 has at an upper end thereof an opening into which a piston cylinder 521 is received for longitudinal movement therethrough. The inner wall of the housing 511 at a lower end thereof is tapered adjacent the outlet channel 514 to facilitate rapid dispensing of the viscous liquid material L from the chamber 512.

It is preferred that the valve housing 511 is composed of a material that exhibits good corrosion resistance and provides for the highest purity and hygienic standards for the sanitary dispensing of viscous flowable materials. Most preferably, the Valve housing 511 is composed of a high-grade stainless steel that is without seams, threads, welds or other surface defects or imperfections that would permit the accumulation or accretion of undesirable particles that would result in the contamination of the dispensed material.

The material flow regulator 540 has a regulator body 541 sized for receipt into an upper opening in the valve housing 511 and sealed therein by a seal member 542 and retainer 543 for displaceable movement therethrough. A tip portion 544 of the regulator body 541 is substantially conical-shaped and combines with a corner sidewall portion of the inlet channel 513 to create a flow passage or channel through which the viscous liquid material L flows into the valve chamber 512. This feature is advantageous in minimizing turbulent flow into the chamber 512 to prevent undesirable splashing and gas bubble formation during a dispensing operation. This is further advantageous in maintaining consistent flow rates of the viscous liquid material L, and thus, more rapid and precise dispensing of the viscous liquid material L. This is especially advantageous because of varying flow rates of the viscous liquid material L at each fill valve station 540 due to the various factors that effect the flow rate of the viscous liquid material L during a filling operation, such as the physical properties (fluid temperature, pressure, viscosity, compressibility) of the viscous liquid material L in addition to the location of each fill valve 510 and fill valve station 540 relative to the manifold M. For instance, the flow rates of a fill valves 510 at the center of the manifold M may differ from those on the outer periphery of the manifold M, thereby requiring means 540 for regulating or adjusting the relative flow rates of the fill valves 510 so that exact amounts of viscous liquid material L may be dispensed simultaneously from each fill valve 510.

Figure 28:
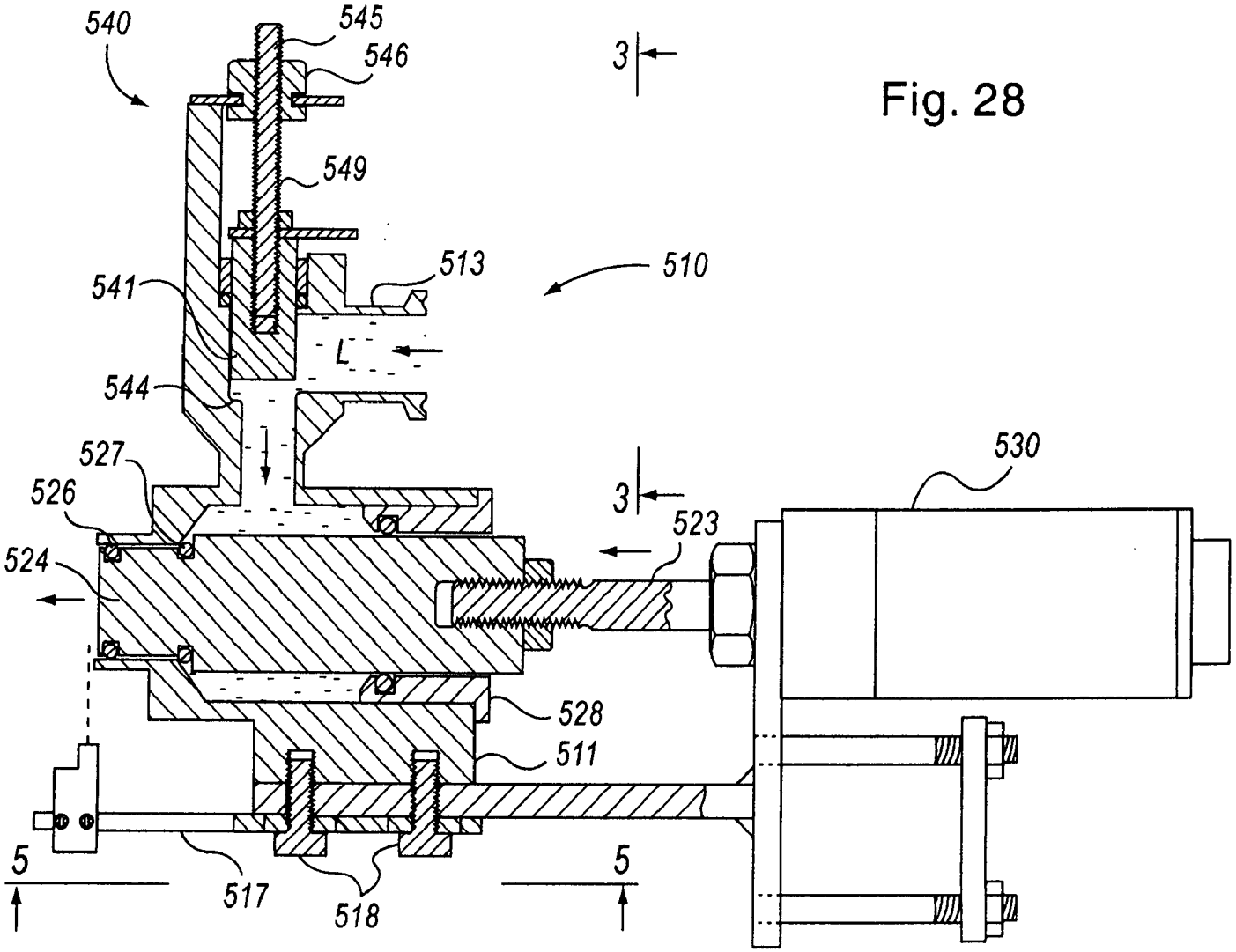
FIG. 28 is a front elevational view partly in section illustrating a further embodiment of the sanitary fill valve assembly in accordance with the invention.

Note that the tip portion 544 of the regulator body 541*v* may alternatively be provided with any geometric shape or combinations thereof which permit effective flow rate control during dispensation. Such an alternative design is illustrated in FIG. 28, in which the tip portion 544 of the regulator body 541 has a substantially rectangular shape while the wall of the inlet passage 513 is tapered.

The regulator body 541 is disposed in the path of flow in the inlet channel 513 to positively adjust the flow rate of the viscous liquid material L by reducing and/or increasing the flow area into the chamber 512 in relation to the varying physical characteristics (as temperature, viscosity, density, pumping pressure, etc.) of the viscous liquid material L. This provides additional protection against sloshing, dripping and undue turbulence. This is particularly advantageous where viscous liquid materials L of varying physical characteristics such as density, pump pressure, viscosity, compressibility, etc. are dispensed in a mechanized sanitary filling operation which utilizes a plurality of sanitary fill valves 511 since the adjustability of the regulator body 541 can be used to control the rate of flow and the amount of liquid material being dispensed in individual sanitary fill valves 511 in relation to the aforementioned physical characteristics.

The tip portion 544 extends downwardly towards the chamber 512 while an internal area defining an opening 547 containing engagement teeth 548 which receive and mate with the outer threads 549 of a screw 545. The regulator body 541 is adjustably displaced via a threaded screw 545 and adjustment nut 546 arrangement that provides for enhanced control of the regulator body 541.

In a preferred embodiment of the invention, a regulator body 541 having a diameter of about 0.5 inches to about 6 inches is used. However, smaller or larger diameters may be used depending upon the particular requirements. It is preferred that the regulator body 541 is composed of any self-lubricating, abrasive-resistant, rust-resistant and hygienic material. Most preferably, a material such as stainless steel is utilized to form the regulator body 541.

The displacement distance of the regulator body 541 is controlled by the number of turns made to the screw 544 via the nut 545. Accordingly, by adjusting the opening of the regulator body 541 with the screw 544, the required flow rate is set. Specifically, controlling the distance of displacement of the regulator body 541 serves to increase and/or decrease the flow area at the flow path between the inlet channel 513 and the chamber 512. Accordingly, the adjustment of the flow area serves to determine the rate of flow of the viscous liquid material L as well as the volume of viscous liquid material L drawn into the chamber 512. While the material flow regulator 540 is shown to be manually actuated using the screw 545 and adjustment nut 546 arrangement, such adjustment may be performed electronically using any electronic actuator known in the art. Such alternative actuators may include a pneumatic actuator, an electromagnetic actuator or the like.

The material dispenser 520 includes a piston assembly having a piston cylinder 521 and piston rod 522 driven or otherwise actuated by the pneumatic actuator 530 for reciprocating movement in the chamber 512 between a first position drawing the viscous liquid material L into the chamber 512 and a second position metering an exact amount of viscous liquid material L from the chamber 512 into a respective container C. The piston body 521 has a main section 523 disposed within the upper section of housing 512 and a substantially conical-shaped lower head portion 524 sized for receipt into the outlet channel 514. The lower head portion 524 is smaller in diameter than the main section 523 and is provided at an outer periphery thereof with a pair of channels 525 for receiving a pair of seal members 526, 527 which positively seals the piston body 521 in the chamber 512 to thereby prevent leakage of the dispensed viscous liquid material L during a dispensing cycle or sequence. The piston 521 is also sealed in the chamber 512 at the upper end of the housing 511 using a cylindrical bushing 528 and an upper seal member 529. The bushing 528 is press fit into the opening at the upper end of the valve housing 511 while the upper seal member 529 is retained in an inner circumferential space of the bushing 528 to form a tight seal between piston body 521 and the valve housing 511. The lower seal members 526, 527 are retained on the piston body 521 by the channels 525 respectively to slidably seal piston body 521 within the chamber 512 of the housing 511. Seal member 526 serves a dual purpose in facilitating the cleaning-in-place of the valve housing 511 by wiping the inner wall of the outlet channel 514 by friction and impulsing the viscous liquid material L to separate therefrom. This is advantageous in reducing unsanitary spilling and dripping of the dispensed viscous liquid material. L through the outlet channel 514.

It is preferred that the bushing 528 is composed of a polymeric material that provides a low friction coupling between the piston body 521 and the valve housing 511, and meets the standards for sterilization set by the FDA. Most preferably, a high-grade silicone or polyurethane material is utilized to form the bushing 528. Most preferably, a composition of Delrin® or Teflon® may be utilized to form the bushing 528.

The upper end of the piston body 521 is a cavity having internal threads for receiving and mating with a plurality of outer threads of the piston rod 522. The upper end of the piston rod 522 is connected to the actuator 530 to transmit a force sufficient to rapidly reciprocate the piston body 521 between the first position and the second position.

In accordance with another embodiment of the invention, in order to provide enhanced dispensing speeds to and greater control of the fill valve assembly 510, the piston body 523 may be alternatively be actuated using a pneumatic actuator 530 connected in series and used in combination with a dampener mechanism such as a compression spring 532. In such a design, the compression spring 532 is received by a piston rod 522 which is threadingly attached to a connection block 533 via an adjustment nut 534, which also serves to adjust the compression of the spring 532. The pneumatic cylinder 530 is connected to an upper end of the block 533 via a thread 535 and nut 536 arrangement. The spring 532 is positioned between the upper end of the piston body 523 and the basal end of the block 533. The spring 532 preferably abuts the basal end of the block 533, and resistively dampens the retraction of the piston body 523 when the piston body is engaged in an open position. The spring 532 is preferably manufactured from a stainless steel. Turning the adjustment nut 534 either compresses or decompresses the spring 532 to respectively increase or decrease the sliding resistance of the piston body 521 when placed in an open or closed position. Such a design is also advantageous in dispensing the need for one-on-one actuation of the piston 520 during a filling operation, thereby permitting a plurality of fill valves 510 to be actuated using a one or more actuators 530.

Typically, the piston body 521 operates at pressures from about 2 to 60 psi for rapidly dispensing a metered amount of the viscous liquid material L into a container C without splashing and/or dripping. While it is preferred that a pneumatic actuator is employed to drive the piston assembly, it is appreciated by those skilled in the art that alternative actuators may also be used.

During a filling operation or sequence, the actuator 530 displaces the piston body 521 from an upward or first position which draws a predetermined volume of the viscous liquid material L into the chamber 512 via negative pressure created therein. Relative to the varying physical characteristics (as temperature, viscosity, density, pumping pressure, etc.) of the viscous liquid material L, the regulator body 541 adjusts the flow rate of the liquid material L by reducing and/or increasing the flow area into the chamber 512. Once the predetermined volume of viscous liquid material L enters into the chamber 512, the actuator device 530 imparts a driving force sufficient to displace the piston 521 downwardly into the second position, thereby causing the viscous liquid material L to be dispensed or discharged from the chamber 512 and into a respective container C. Accordingly, the interaction between the piston assembly 520, actuator 530 and regulator 540 permits a rapid and precise metered amount of viscous liquid material L to be dispensed into a container C in a controlled manner.

Alternatively, a suitable timing and control apparatus known in the art can be coupled to the actuator 530 and the regulator assembly 540 and utilized to selectively determine the volume of viscous liquid material L to be drawn into the chamber 512 by displacing piston body 521 and the regulator body 541 a selected distance based upon certain operation parameters, such as compressibility, temperature, fluid viscosity, fluid density, etc.

The fill valve assembly 510 in accordance with the invention is advantageous in being adaptable to rapidly and efficiently deliver or otherwise dispense and meter precise or uniform quantities of viscous liquid material into an interior cavity of a vessel, container or the like, even under varying physical conditions of the dispensed viscous liquid material. The fill valve and fill valve assembly of the invention is also advantageous in reducing turbulent flow to thereby permit dispensing of the viscous liquid material without unwanted splashing or gaseous bubble formation. The fill valve and fill valve assembly of the invention is further advantageous in providing for efficient and quick filling operations in automatically regulating the rate of flow of dispensed viscous liquid material L. The fill valve assembly 510 of the invention is even further advantageous in providing a sealed piston assembly which positively seals the piston within the housing while also cleaning-in-place the outlet passage to thereby reduce undesirable dripping of the dispensed viscous liquid material.

It is apparent that innumerable variations of the preferred embodiments described hereinbefore may be utilized. However, all such variations within the spirit and scope of the invention are deemed to be covered by the following claims.

What is claimed is:

1. An apparatus for the sanitary filling of a plurality of containers with viscous liquid material, said apparatus comprising:

a sanitary pump mechanism for delivering the viscous liquid material under pressure to a viscous liquid material manifold;

a pump pulsation dampening assembly provided in series between said sanitary pump mechanism and said viscous liquid material manifold for substantially dampening an occurrence of pulsating fluid flow of the viscous liquid material, said pump pulsation dampening assembly having a sanitary cleaning mechanism that permits a cleaning-in-place operation of said pump pulsation dampening assembly; and a plurality of sanitary fill valves for drawing the viscous liquid material from the viscous liquid material manifold and dispensing simultaneously precise metered amounts of the viscous liquid material into the plurality of containers.

2. The apparatus of claim 1, wherein said pump pulsation dampening assembly comprises a pressurized vessel having an interior surface defining a chamber for receiving the viscous liquid material from said sanitary pump mechanism.

3. The apparatus of claim 2, wherein said chamber containing a pocket of pressurized air therein for absorbing said pulsating fluid flow.

4. The apparatus of claim 3, wherein said sanitary cleaning mechanism comprises a conduit having an inlet port for receiving a volume of sanitized fluid from a sanitized fluid source and an outlet port disposed inside said chamber for dispensing a sanitized fluid therein to facilitate a cleaning-in-place operation of said interior surface of said pressurized vessel.

5. The apparatus of claim 4, wherein said outlet port comprises a nozzle head having a plurality of apertures for discharging the sanitized fluid.

6. The apparatus of claim 1, further comprising an overpressure relief valve in communication with said chamber of said pressurized vessel for discharging air inside said chamber when the pressure inside said chamber exceeds a desired level.

7. The apparatus of claim 1, further comprising a sensing mechanism for monitoring the air-to-liquid ratio inside said chamber and an adjustment mechanism in communication with said sensing mechanism for adjusting the air-to-liquid ratio inside said chamber to a desired level in response to the duration and intensity of the pulsating viscous liquid material flow.

8. The apparatus of claim 7, wherein said sensing mechanism comprises a main body and a probe extending therefrom and into said chamber, said probe being adaptable to monitor the air-to-liquid ratio inside said chamber.

9. The apparatus of claim 8, wherein said adjustment mechanism automatically adjusts the air-to-liquid ratio in response to the duration and intensity of the pulsating viscous liquid material flow.

10. The apparatus of claim 1, further comprising a supplemental dampener and pulse rate monitor in communication with said chamber for absorbing at least a portion of said pulsating fluid flow and facilitating monitoring of the rate of pulsating fluid flow.

11. The apparatus of claim 10, wherein said supplemental dampener and pulse rate indicator is enclosed in an expandable container.

12. The apparatus of claim 11, wherein said expandable container comprises a translucent material to permit the rate of pulsation to be observed manually without the aid of tools.

13. The apparatus of claim 12, wherein said supplemental dampener and pulse rate indicator comprises at least one expandable vessel having an interior chamber that expands and contracts in response to the pulsating action of said pump mechanism.

14. The apparatus of claim 13, wherein said expandable vessel comprises a deformable material having mechanical memory.

15. The apparatus of claim 14, wherein said deformable material comprises rubber.

16. The apparatus of claim 1, further comprising a pressure regulator in communication with said chamber to regulate the pressure therein.

17. The apparatus of claim 1, wherein said chamber is sized relative to the duration and intensity level of said pulsating output.

18. A filling apparatus comprising:

a pump delivery system for delivering viscous liquid material under pressure to a viscous liquid material manifold, said sanitary pump delivery system being adaptable to also substantially dampen any pulsating output of the viscous liquid material during a filling operation; and a plurality of fill valves for dispensing simultaneously precise quantities of the viscous liquid material into a plurality of containers, each one of said fill valves being in communication with said viscous liquid material manifold via a fill valve station and also having a flow regulator for automatically regulating the rate of flow of the viscous liquid material from the fill valves, said automatic flow regulation being based at least upon the location of a respective one of said fill valve stations relative to said manifold to thereby permit the simultaneous dispensing of the viscous liquid material during a filling operation.

19. The apparatus of claim 18, wherein each one of said fill valves includes a valve inlet passage for receiving the viscous liquid material from said manifold, an annular valve chamber for receiving the viscous liquid material from said valve inlet passage, a valve outlet passage from which the viscous liquid material is dispensed into a respective container.

20. The apparatus of claim 19, wherein said flow regulator automatically regulates the rate of flow of the viscous liquid material by at least one of reducing and increasing the flow area into said valve chamber.

21. The apparatus of claim 20, wherein each one of said fill valves comprises an ON/OFF positive controlled viscous liquid material dispenser for dispensing the viscous liquid material from said valve chamber.

22. The apparatus of claim 21, wherein said material dispenser comprises a piston cylinder.

23. The apparatus of claim 22, wherein said piston cylinder includes a main piston body and a piston head disposed at a distal end thereof for dispensing the viscous liquid material from said valve chamber.

24. The apparatus of claim 23, wherein an annular surface of said valve housing has a tapered wall adjacent said valve outlet passage that forms a seat for said main piston body.

25. The apparatus of claim 24, further comprising a seal mechanism for positively sealing said piston cylinder in said valve chamber.

26. The apparatus of claim 25, wherein said seal mechanism comprises a first seal member disposed on said piston head for cleaning-in-place said outlet passage to prevent dripping of the viscous flowable material during a dispensing cycle, a second seal member disposed intermediate said main piston body and said piston head for positively shutting off flow of the viscous liquid material during a dispensing cycle and a third seal member disposed adjacent said main piston body for preventing fluid leakage at a basal end thereof.

27. The apparatus of claim 26, further comprising a drive mechanism for actuating said piston cylinder.

28. The apparatus of claim 27, wherein said drive mechanism comprises a pneumatic cylinder.

29. The apparatus of claim 20, wherein said viscous liquid material flow regulator comprises a regulator body and a regulator adjustment mechanism for selectively displacing said regulator body within said valve housing between a downward position decreasing the flow area into said valve chamber and an upward position increasing the flow area into said valve chamber.

30. The apparatus of claim 29, wherein said regulator adjustment mechanism comprises a threaded screw and an adjustment nut, said threaded screw having a lower end connected to an upper portion of said regulator body and an upper end connected to said adjustment nut, wherein rotation of said adjustment nut and said threaded screw causes to displace said regulator body.

31. The apparatus of claim 29, wherein said regulator adjustment mechanism comprises an electric actuator.

32. An apparatus adapted for use in a sanitary filling operation for the simultaneous metered filling of precise quantities of viscous liquid material into a plurality of containers, said apparatus comprising:

(a) a double action pump mechanism for delivering the viscous liquid material to a viscous liquid material manifold, said sanitary pump mechanism including a housing sized to receive a piston cylinder having a positively-controlled piston head for reciprocating movement therein, said housing having a pair of inlet ports and a pair of outlet ports disposed, each one of said inlet ports and said outlet ports having a check valve removably and sealingly disposed therein for substantially reducing turbulence and cavitation during a filling operation;

(b) a pump pulsation dampening mechanism for substantially dampening an occurrence of pulsating fluid flow generating by said pump mechanism; and (c) a plurality of fill valves for simultaneously dispensing a precise metered amount of the viscous liquid material into the containers.

33. The apparatus of claim 32, wherein said pump mechanism further comprises a compression seal including an O-ring seal with a flat face.

34. The apparatus of claim 33, wherein said compression seal further comprises a compression nut threaded to one of said removeably sealable ends for compressing said O-ring seal.

35. The apparatus of claim 34, wherein said compression seal includes a pair of O-ring seals with flat faces are wiper seals and a compression washer disposed intermediate between said pair of O-ring seals a bushing disposed between one of said O-ring seals and said compression nut.

36. The apparatus of claim 32, wherein said check valve is a sanitary check valve.

37. The apparatus of claim 32, wherein said check valve has a valve stem guide and a valve seat guide.

38. The apparatus of claim 36, wherein said sanitary check valve includes a separate separable check valve housing disposed in said inlet ports and said outlet ports.

39. The apparatus of claim 38, wherein said separable check valve housing includes a valve seat and a valve guide having means for controlling the radial motion of the check valve.

40. The sanitary pump of claim 39, wherein said check valve includes a stem portion terminating in a conical shaped base for receiving a spring and said check valve housing includes a valve stem guide having a cavity for receiving said spring and limiting the radial motion of said check valve in operation.

41. The apparatus of claim 40, wherein said valve stem guide includes a collar for receiving said stem and limiting the radial motion of said check valve in operation.

42. The apparatus of claim 40, wherein said check valve includes an O-ring seal and a valve seat guide for fitting within said valve seat of said housing for limiting the radial motion of said check valve in operation.

43. The apparatus of claim 40, wherein said separable check valve housing includes flanges for interconnecting said separable check valve housing.

44. The apparatus of claim 32, wherein said removeably sealable ends are interchangeable.

45. The apparatus of claim 44, wherein both of said removeably sealable ends include a compression seal for said removeable piston drive shaft.

46. The apparatus of claim 32, wherein said piston drive shaft includes means for adjusting the length of said piston head stroke in said cylinder housing.

47. The apparatus of claim 32, wherein said inlet ports and said outlet ports are disposed in said housing.

48. The apparatus of claim 32, wherein said inlet ports and said outlet ports are disposed on said removeably sealable ends.

49. The apparatus of claim 32, wherein said inlet ports are disposed on said removeably sealable ends and said outlet ports are disposed in said housing.

50. The apparatus of claim 32, wherein said removeably sealable ends are interchangeable and are removably connected to said housing.

51. The apparatus of claim 32, further comprising a drive mechanism for driving said piston cylinder.

* * * * *